US010857793B2

(12) United States Patent
Kato

(10) Patent No.: US 10,857,793 B2
(45) Date of Patent: Dec. 8, 2020

(54) LIQUID DISCHARGE HEAD, HEAD MODULE, HEAD UNIT, LIQUID DISCHARGE DEVICE, AND LIQUID DISCHARGE APPARATUS

(71) Applicant: Masaki Kato, Tokyo (JP)

(72) Inventor: Masaki Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/297,842

(22) Filed: Mar. 11, 2019

(65) Prior Publication Data

US 2019/0275797 A1 Sep. 12, 2019

(30) Foreign Application Priority Data

Mar. 12, 2018 (JP) ..... 2018-043815

(51) Int. Cl.
*B41J 2/14* (2006.01)
*B41J 2/175* (2006.01)
*B41J 2/185* (2006.01)

(52) U.S. Cl.
CPC ..... *B41J 2/14233* (2013.01); *B41J 2/175* (2013.01); *B41J 2/185* (2013.01);
(Continued)

(58) Field of Classification Search
CPC ..... B41J 2/14233; B41J 2/185; B41J 2/175; B41J 2002/14419; B41J 2002/14362;
(Continued)

(56) References Cited

U.S. PATENT DOCUMENTS

2011/0316934 A1* 12/2011 Nishikawa ..... B41J 2/14233 347/54
2017/0001441 A1 1/2017 Kato
(Continued)

FOREIGN PATENT DOCUMENTS

JP 2002-307676 10/2002
JP 2010-241120 10/2010
(Continued)

OTHER PUBLICATIONS

IP.com search (Year: 2020).*

*Primary Examiner* — Lisa Solomon
(74) *Attorney, Agent, or Firm* — Harness, Dickey & Pierce, P.L.C.

(57) ABSTRACT

A liquid discharge head includes nozzles, pressure chambers, individual supply channels, individual collection channels common supply channel branches, and common collection channel branches. The common supply channel branches communicate with two or more of the individual supply channels. The common collection channel branches communicate with two or more of the individual collection channels. The nozzles are two-dimensionally arranged in a matrix and arranged in at least a first direction and a second direction intersecting with the first direction at an inclination. The common supply channel branches and the common collection channel branches extend in the first direction. The common supply channel branches and the common collection channel branches are alternately arranged in the second direction. An arrangement interval between the common supply channel branches and the common collection channel branches is equal to or more than twice an arrangement interval between the nozzles arranged in the second direction.

20 Claims, 20 Drawing Sheets

(52) U.S. Cl.
CPC ..... *B41J 2002/14362* (2013.01); *B41J 2002/14419* (2013.01); *B41J 2002/14459* (2013.01); *B41J 2202/11* (2013.01)

(58) Field of Classification Search
CPC ..... B41J 2202/11; B41J 2002/14459; B41J 2202/12; B41J 2202/20; B41J 2202/19; B41J 2002/14241
See application file for complete search history.

(56) References Cited

U.S. PATENT DOCUMENTS

| | | | | |
|---|---|---|---|---|
| 2017/0100935 | A1 | 4/2017 | Yoshiike | |
| 2017/0151782 | A1 | 6/2017 | Takahashi et al. | |
| 2017/0197421 | A1* | 7/2017 | Okushima ..... | B41J 2/14016 |

FOREIGN PATENT DOCUMENTS

| | | | |
|---|---|---|---|
| JP | 2011-520665 | | 7/2011 |
| JP | 2014-510649 | | 5/2014 |
| JP | 2015-036238 | | 2/2015 |
| JP | 2017-071163 | | 4/2017 |
| WO | WO2009/142894 | A1 | 11/2009 |
| WO | WO2012/091867 | A2 | 7/2012 |

* cited by examiner

LIQUID DISCHARGE HEAD, HEAD MODULE, HEAD UNIT, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-043815, filed on Mar. 12, 2018, in the Japan Patent Office, the entire disclosure of which is incorporated by reference herein.

BACKGROUND

Technical Field

The present disclosure relates to a liquid discharge head, a head module, a head unit, a liquid discharge device, and a liquid discharge apparatus.

Related Art

A liquid discharge head for discharging a liquid needs to suppress crosstalk that pressure fluctuation due to discharge of a liquid affects discharge characteristics of another pressure chamber (individual liquid chamber) through a common channel.

SUMMARY

In an aspect of the present disclosure, there is provided a liquid discharge head that includes a plurality of nozzles, a plurality of pressure chambers, a plurality of individual supply channels, a plurality of individual collection channels, a plurality of common supply channel branches, and a plurality of common collection channel branches. The plurality of nozzles discharges a liquid. The plurality of pressure chambers respectively communicates with the plurality of nozzles. The plurality of individual supply channels respectively communicates with the plurality of pressure chambers. The plurality of individual collection channels respectively communicates with the plurality of pressure chambers. The plurality of common supply channel branches communicates with two or more of the individual supply channels. The plurality of common collection channel branches communicates with two or more of the individual collection channels. The plurality of nozzles is two-dimensionally arranged in a matrix and arranged in at least a first direction and a second direction intersecting with the first direction at an inclination. The common supply channel branches and the common collection channel branches extend in the first direction. The common supply channel branches and the common collection channel branches are alternately arranged in the second direction. An arrangement interval between the common supply channel branches and the common collection channel branches is equal to or more than twice an arrangement interval between the nozzles arranged in the second direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
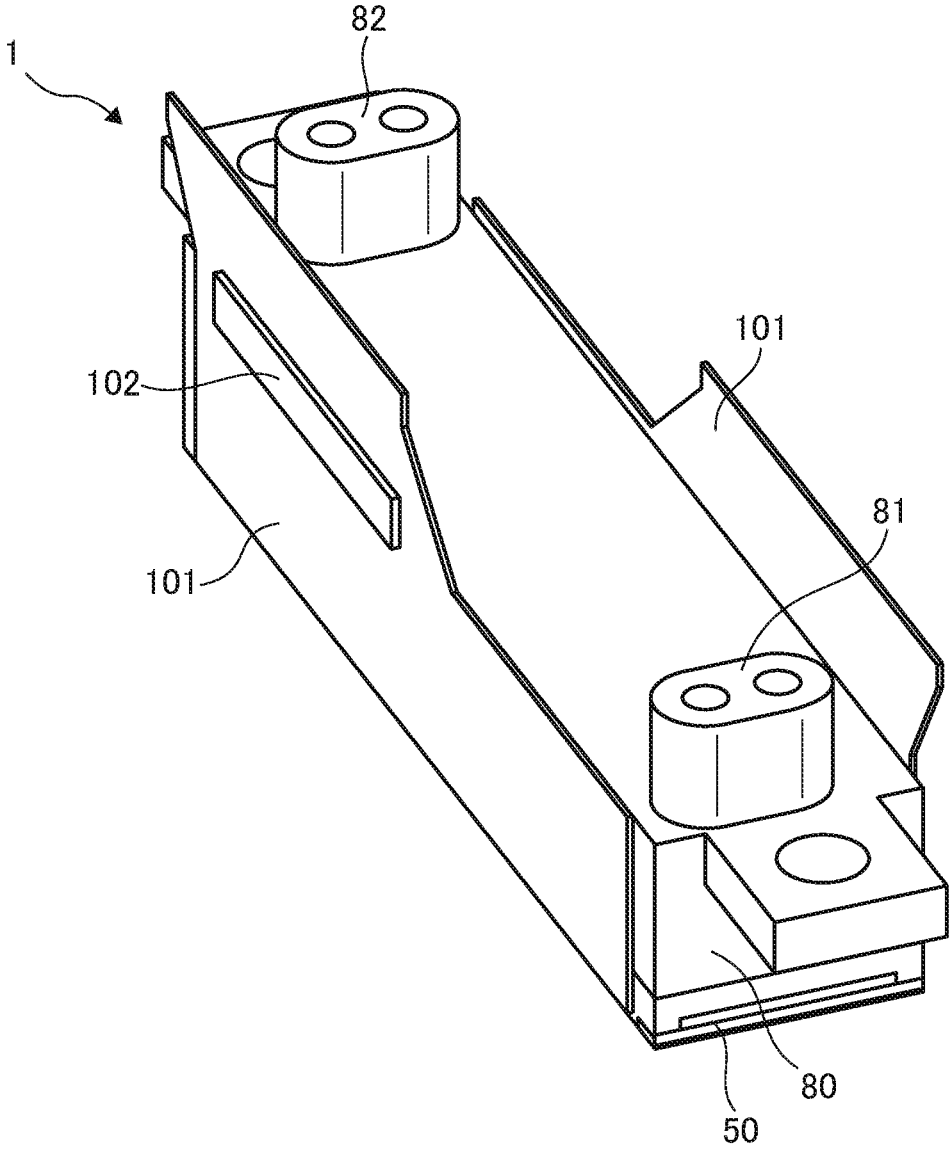
FIG. 1 is a perspective explanatory view of an external appearance of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
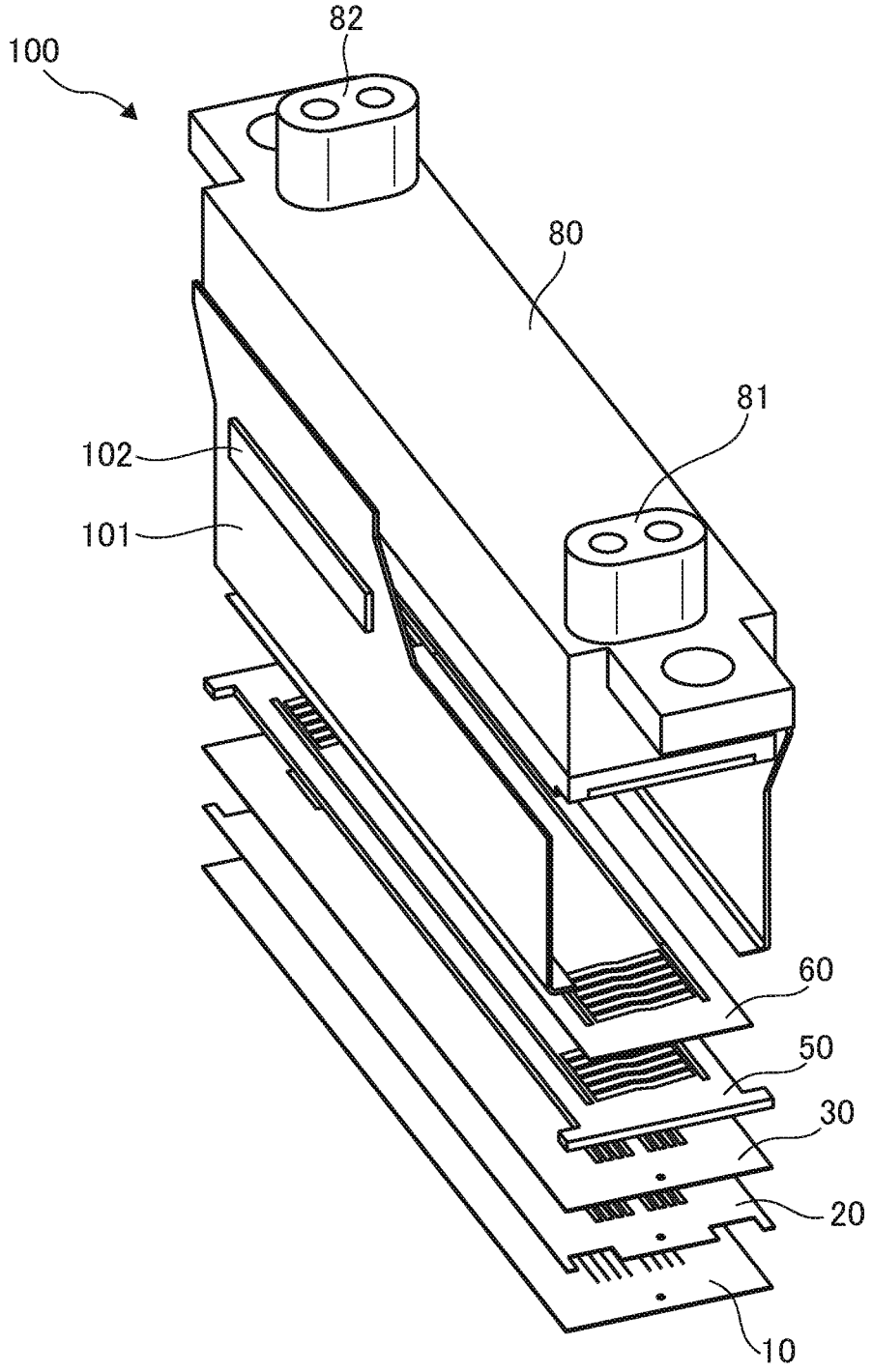
FIG. 2 is an exploded perspective explanatory view of the liquid discharge head.
Figure 3:
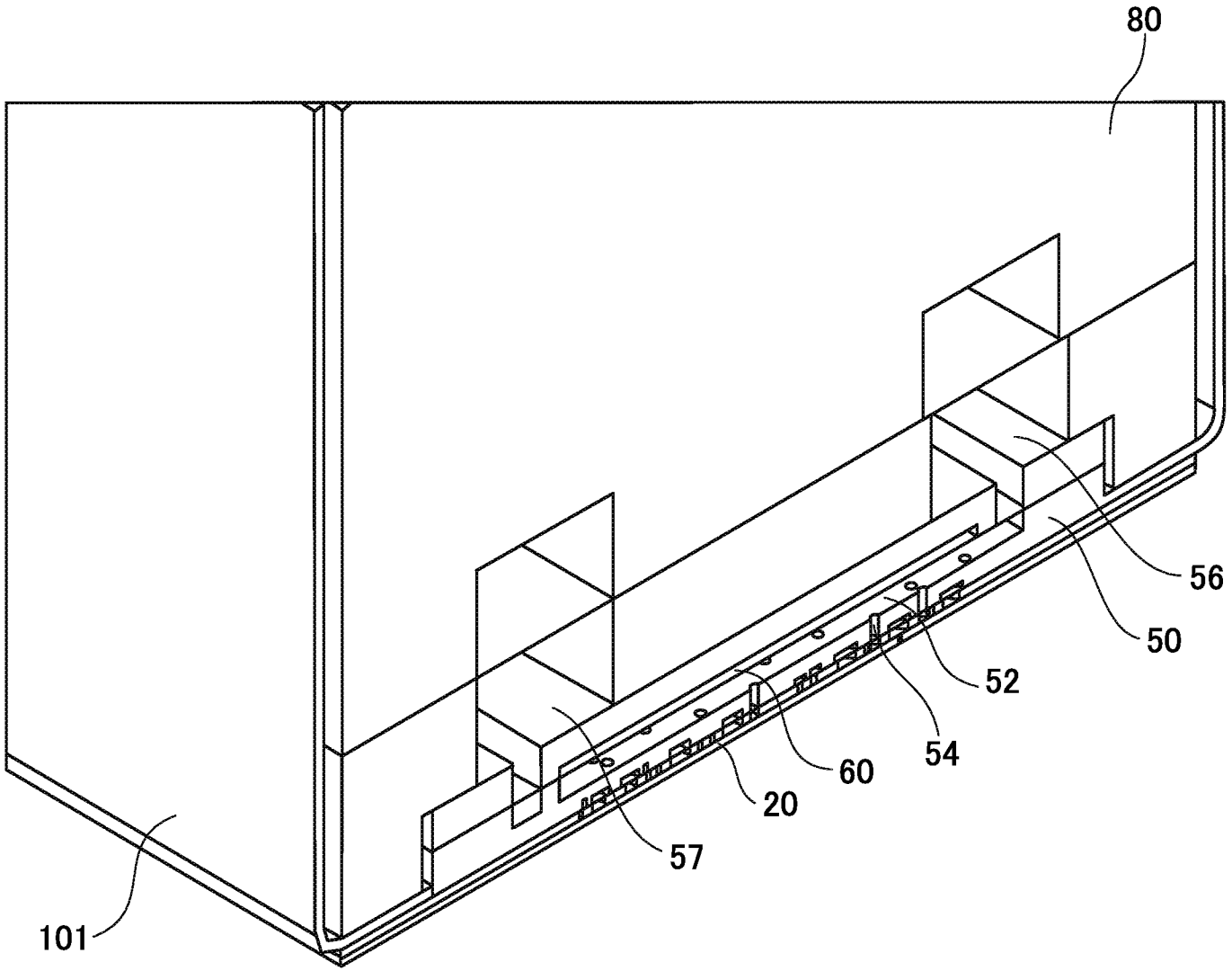
FIG. 3 is a cross-sectional perspective explanatory view of the liquid discharge head.
Figure 4:
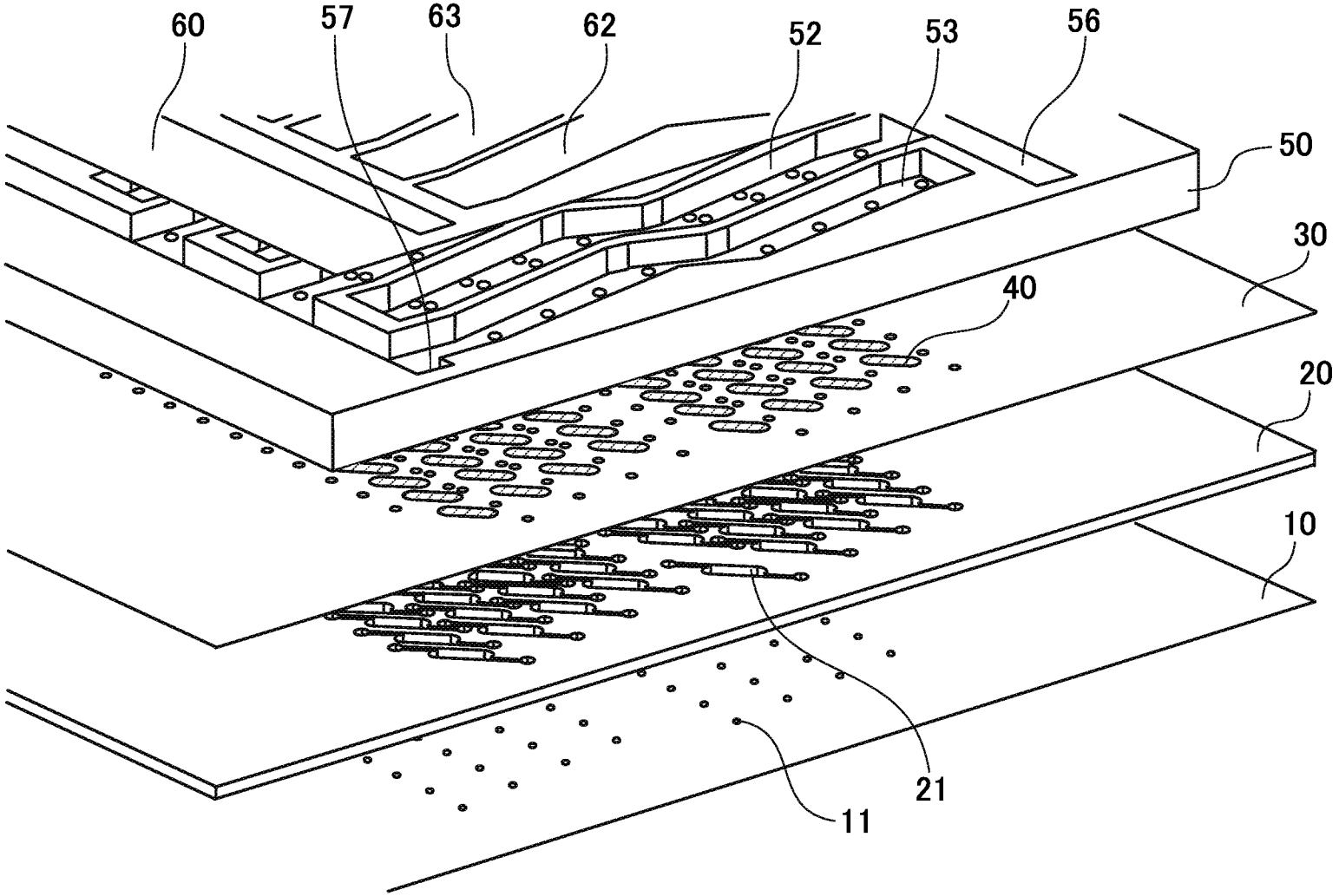
FIG. 4 is an exploded perspective explanatory view of the liquid discharge head, excluding a frame member.
Figure 5:
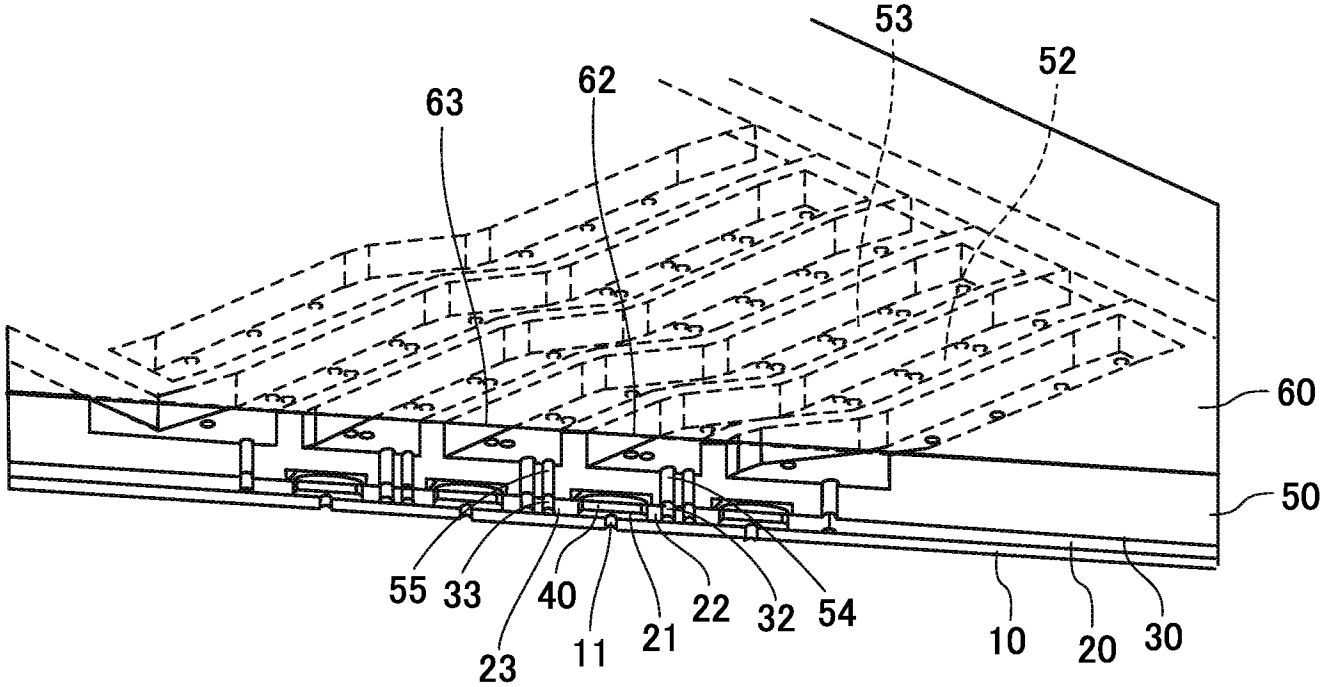
FIG. 5 is a cross-sectional perspective explanatory view of a channel portion of the liquid discharge head.
Figure 6:
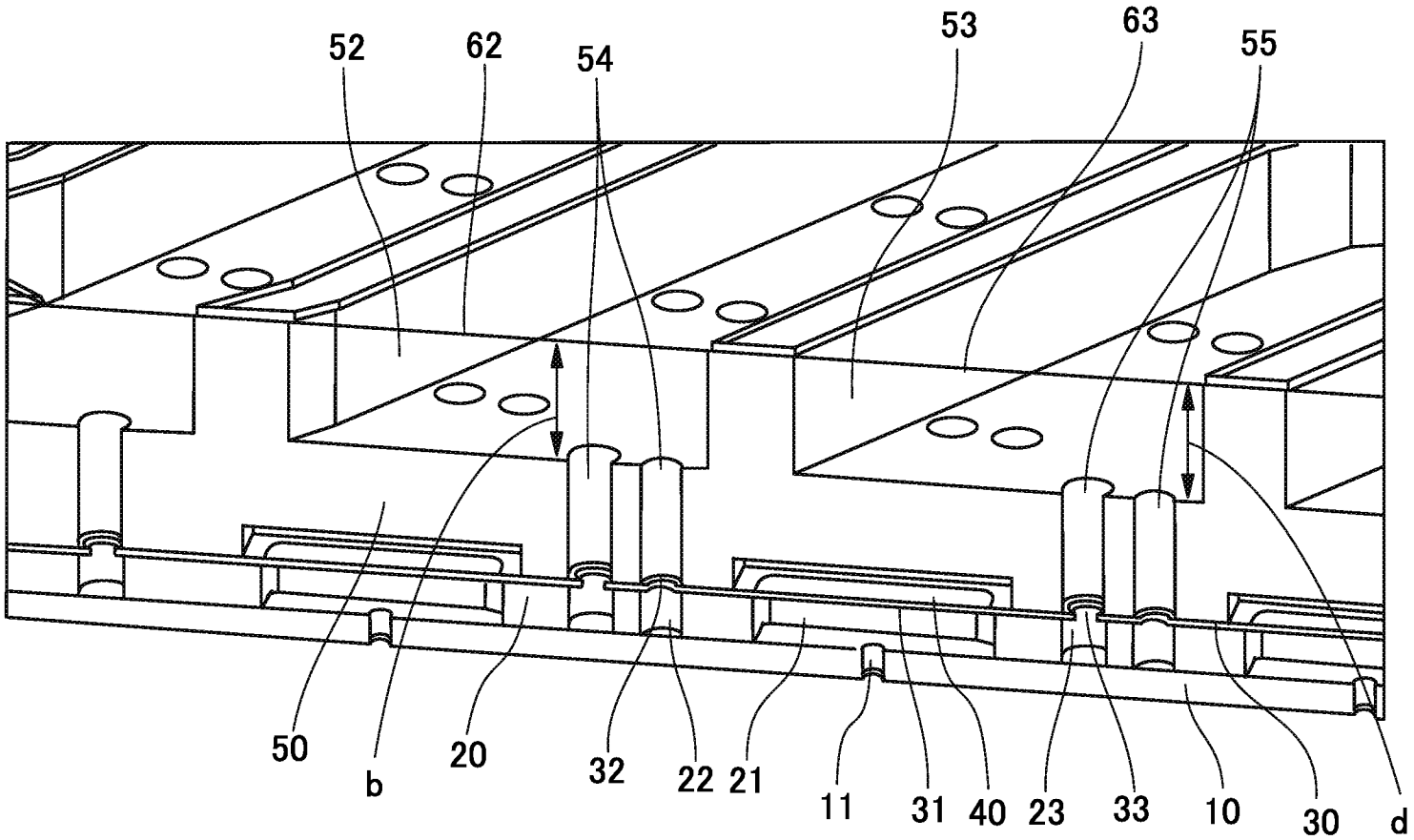
FIG. 6 is an enlarged cross-sectional perspective explanatory view of a channel portion of the liquid discharge head.
Figure 7:
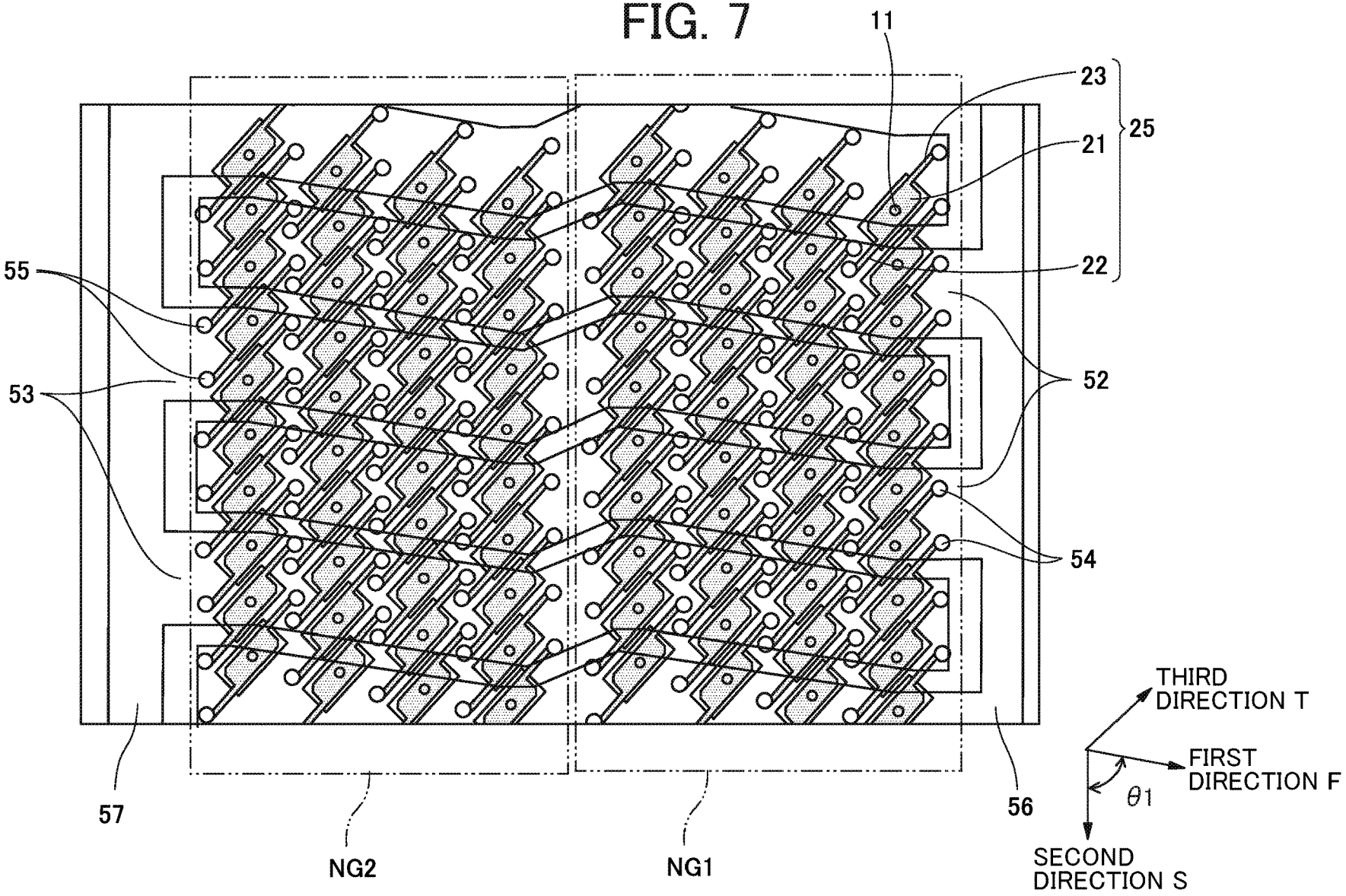
FIG. 7 is a plan explanatory view of a channel portion of the liquid discharge head.

Hereinafter, an embodiment of the present disclosure will be described with reference to the attached drawings. A first embodiment of the present disclosure will be described with reference to FIGS. 1 to 8. FIG. 1 is a perspective explanatory view of an external appearance of a liquid discharge head according to the first embodiment. FIG. 2 is an exploded perspective explanatory view of the liquid discharge head. FIG. 3 is a cross-sectional perspective explanatory view of the liquid discharge head. FIG. 4 is an exploded perspective explanatory view of the liquid discharge head, excluding a frame member. FIG. 5 is a cross-sectional perspective explanatory view of a channel portion of the liquid discharge head. FIG. 6 is an enlarged cross-sectional perspective explanatory view of a channel portion of the liquid discharge head. FIG. 7 is a plan explanatory view of a channel portion of the liquid discharge head.

A liquid discharge head 1 includes a nozzle plate 10, a channel plate (individual channel substrate) 20, a diaphragm substrate 30, a common channel substrate 50, a damper member 60, a frame member 80, a substrate having a drive circuit 102 mounted thereon (flexible wiring substrate) 101, and the like.

The nozzle plate 10 includes a plurality of nozzles 11 for discharging a liquid. The plurality of nozzles 11 is two-dimensionally arranged in a matrix and arranged in three directions of a first direction F, a second direction S, and a third direction T as illustrated in FIG. 7.

The individual channel substrate 20 forms a plurality of pressure chambers (individual liquid chambers) 21 respectively communicating with the plurality of nozzles 11, a plurality of individual supply channels 22 respectively communicating with the plurality of pressure chambers 21, and a plurality of individual collection channels 23 respectively communicating with the plurality of pressure chambers 21. One of the pressure chambers 21, one of the individual supply channels 22 communicating with the pressure chamber 21, and one of the individual collection channels 23 communicating with the pressure chamber 21 are collectively referred to as an individual channel 25.

The diaphragm substrate 30 forms a diaphragm 31 which is a deformable wall surface of the pressure chamber 21, and a piezoelectric element 40 is integrally disposed on the diaphragm 31. On the diaphragm substrate 30, a supply side opening 32 communicating with the individual supply channel 22 and a collection side opening 33 communicating with the individual collection channel 23 are formed. The piezoelectric element 40 is a pressure generator for deforming the diaphragm 31 to pressurize a liquid in the pressure chamber 21.

Note that the individual channel substrate 20 and the diaphragm substrate 30 are not limited to being separate members as members. For example, the individual channel substrate 20 and the diaphragm substrate 30 can be formed integrally with the same member using a silicon on insulator (SOI) substrate. That is, an SOI substrate formed on a silicon substrate in order of a silicon oxide film, a silicon layer, and a silicon oxide film is used, the silicon substrate is used as the individual channel substrate 20, and the silicon oxide film, the silicon layer, and the silicon oxide film can form the diaphragm 31. In this configuration, the layer configuration of the silicon oxide film, the silicon layer, and the silicon oxide film in the SOI substrate serves as the diaphragm substrate 30. As described above, the diaphragm substrate 30 includes a substrate containing film-shaped materials formed on a surface of the individual channel substrate 20.

The common channel substrate 50 forms a plurality of common supply channel branches 52 communicating with two or more of the individual supply channels 22 and a plurality of common collection channel branches 53 communicating with two or more of the individual collection channels 23 alternately so as to be adjacent to each other in a second direction S of the nozzles 11.

In the common channel substrate 50, a through hole serving as a supply port 54 for communicating the supply side opening 32 of the individual supply channel 22 with the common supply channel branch 52 and a through hole serving as a collection port 55 for communicating the collection side opening 33 of the individual collection channel 23 with the common collection channel branch 53 are formed.

The common channel substrate 50 forms one or more common supply channel mainstreams 56 communicating with the plurality of common supply channel branches 52 and one or more common collection channel mainstreams 57 communicating with the plurality of common collection channel branches 53.

The damper member 60 includes a supply side damper 62 facing (opposing to) the supply port 54 of the common supply channel branch 52 and a collection side damper 63 facing (opposing to) the collection port 55 of the common collection channel branch 53.

Here, the common supply channel branch 52 and the common collection channel branch 53 are alternately arranged in the same common channel substrate 50 to form grooves, and the grooves are sealed with the supply side damper 62 or the collection side damper 63 of the damper member 60. Note that a damper material of the damper member 60 is preferably a metal thin film or an inorganic thin film resistant to an organic solvent. The thickness of the damper member 60 in a portion of the supply side damper 62 or the collection side damper 63 is preferably 10 μm or less.

Next, a channel arrangement configuration in the present embodiment will be described with reference to FIGS. 8 to 11. FIGS. 8 to 11 are enlarged plan explanatory views of a main part of FIG. 7. Note that a branch is indicated by an imaginary line.

Figure 8:
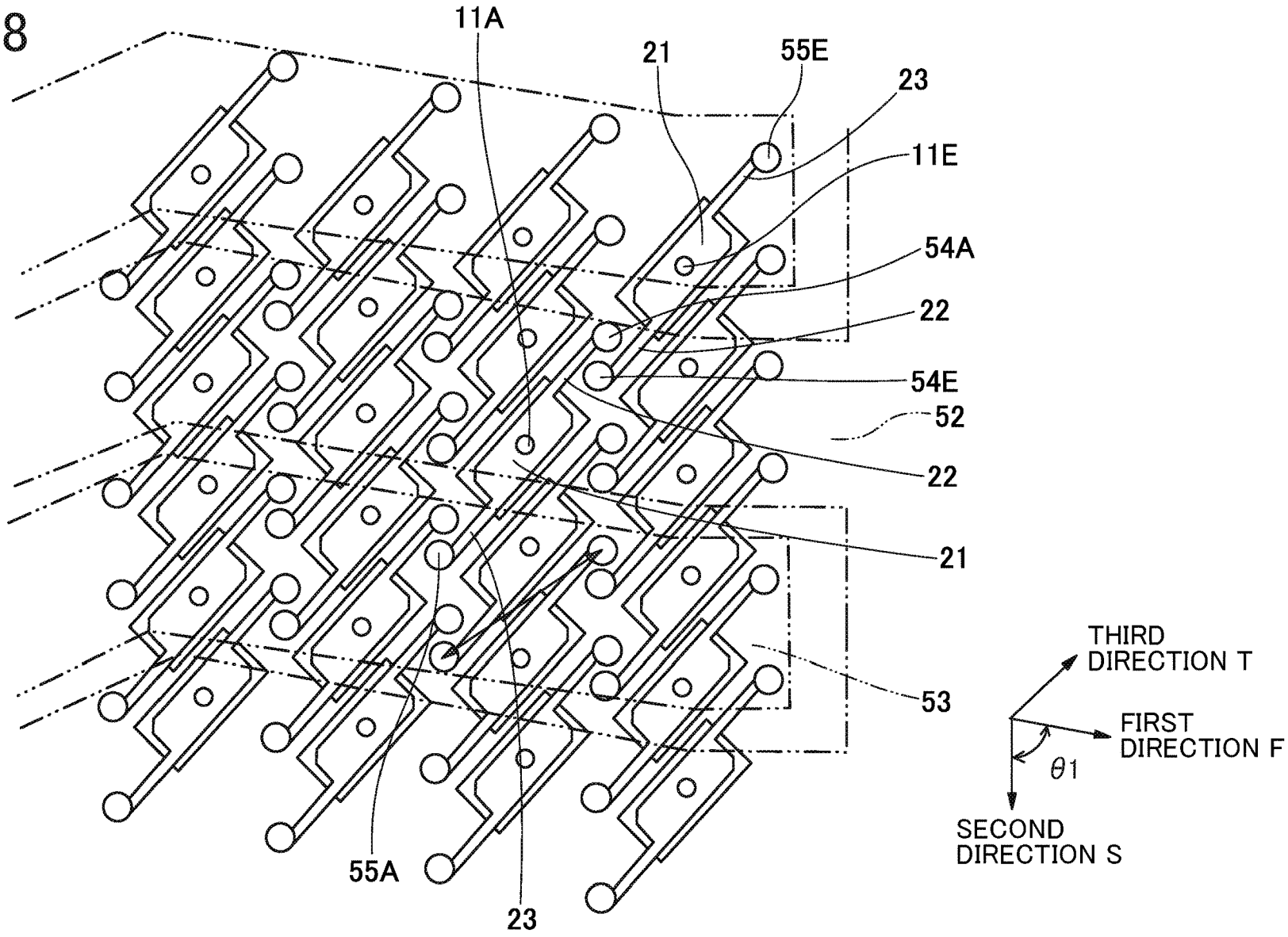
FIG. 8 is an enlarged plan explanatory view of a main part of FIG. 7.

First, with reference to FIG. 8, the plurality of nozzles 11 is two-dimensionally arranged in a matrix and arranged in three directions of the first direction F, the second direction S, and the third direction T. As illustrated in FIG. 7, a group of the nozzles 11 two-dimensionally arranged in a matrix is referred to as a nozzle group NG (NG1 and NG2).

In one nozzle group NG, when arrangement of the plurality of nozzles 11 in the second direction S is referred to as a nozzle row, the first direction F is a direction in which the nozzle rows are arranged at a predetermined inclination angle θ1 with respect to an arrangement direction of the nozzles 11. The common supply channel branch 52 and the common collection channel branch 53 extend in the first direction. Therefore, the longitudinal direction of the common supply channel branch 52 and the common collection channel branch 53 is along the first direction F.

In one nozzle group NG, the second direction S is a direction in which the nearest neighboring nozzles 11 are arranged (nozzle arrangement direction), and is a direction intersecting with the first direction F at the angle θ1 if the first direction F is used as a reference. The common supply channel branch 52 and the common collection channel branch 53 are alternately arranged in the second direction S.

In one nozzle group NG, the third direction T is a direction intersecting with the first direction F and the second direction S. In the present embodiment, the individual channel 25 including the individual supply channel 22, the pressure chamber 21, and the individual collection channel 23 is disposed in the third direction.

Here, the individual channel 25 including the individual supply channel 22, the pressure chamber 21, and the individual collection channel 23 is two-fold rotationally symmetrical with respect to an axis of the nozzle 11 (central axis in a liquid discharge direction).

By making the individual channel 25 two-fold rotationally symmetrical, in the example illustrated in FIG. 8, for example, like a relationship between an individual channel 25 communicating with a nozzle 11A and an individual channel 25 communicating with a nozzle 11E, the individual channel 25 can be reversed and disposed with respect to the nozzles 11A and 11E adjacent to each other in a direction (third direction T) parallel to the flow of a liquid in the individual channel 25.

That is, with respect to the supply port 54A communicating with an individual liquid chamber 21 of the nozzle 11A and the supply port 54E communicating with an individual liquid chamber 21 of the nozzle 11E, disposed in the same common supply channel branch 52, the individual liquid chambers can be reversed and disposed.

As a result, the mounting density of the individual liquid chambers 21 (nozzles 11) can be increased without being restricted by arrangement of the common supply channel branch 52, and the head can be downsized.

Two nozzles 11 respectively communicating with the two nearest neighboring supply ports 54 in the same common supply channel branch 52, for example, in the example of FIG. 8, the nozzle 11A coupled to the supply port 54A and the nozzle 11E coupled to the supply port 54E communicate with different common collection channel branches 53 through collection ports 55A and 55E.

Note that the individual channels 25 are arranged in a translational symmetrical form (not reversed) with respect to the direction (first direction F) of the flow of a liquid in the common supply channel branch 52 and the common collection channel branch 53.

Figure 9:
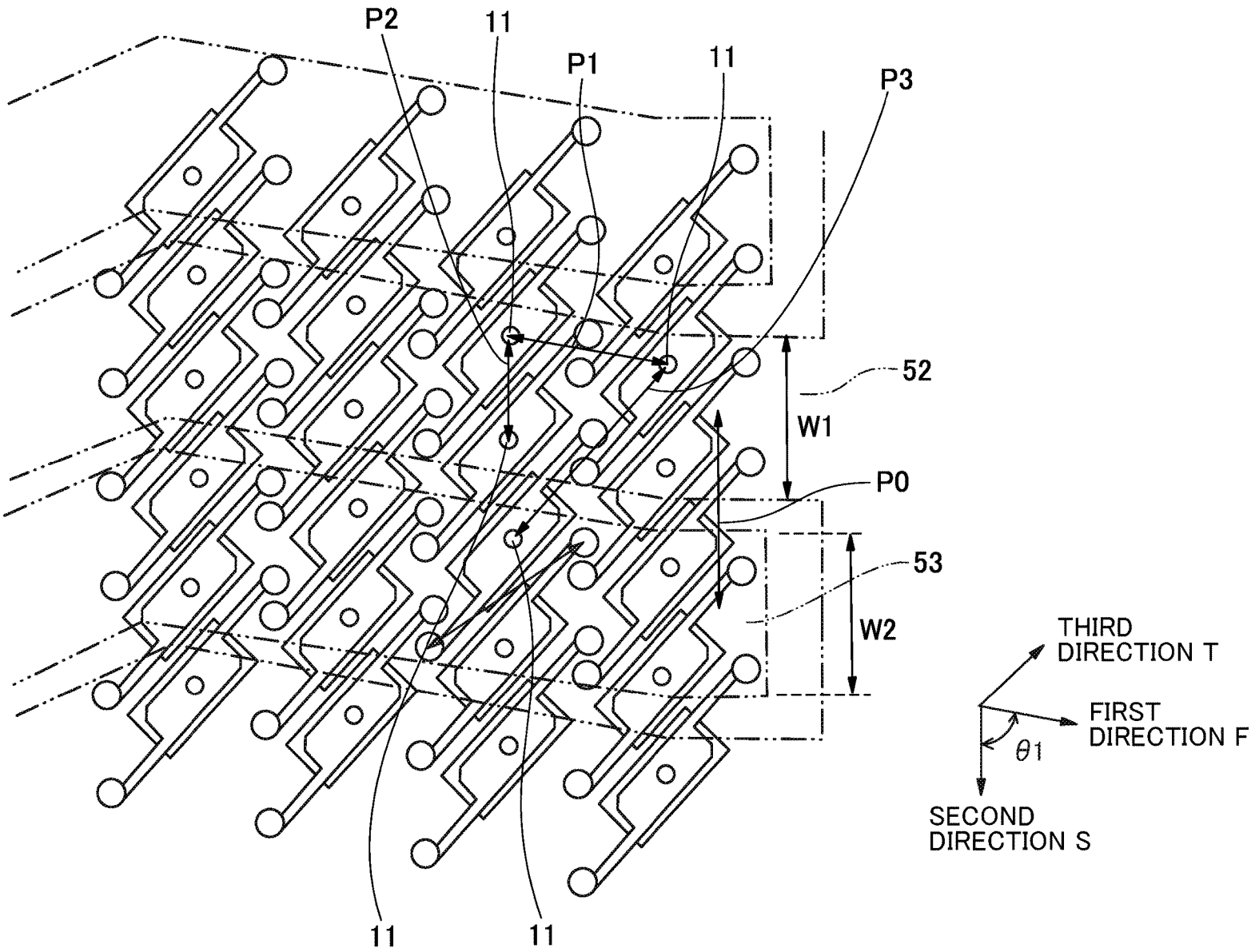
FIG. 9 is an enlarged plan explanatory view of a main part of FIG. 7.

Next, with reference to FIG. 9, an arrangement interval P3 of the nozzles 11 in the third direction T can be set in an arbitrary direction, and can be wider than an arrangement interval P1 of the nozzles 11 in the first direction F and an arrangement interval P2 of the nozzles 11 in the second direction T.

By setting the third direction T such that the arrangement interval P3 of the nozzles 11 in the third direction T can be equal to or more than twice the arrangement interval P2 of the nozzles 11 in the second direction S, an arrangement interval P0 between the common supply channel branch 52 and the common collection channel branch 53 is set to be equal to or more than twice the arrangement interval P2 of the nozzles 11 arranged in the second direction S.

Incidentally, in the present embodiment, the arrangement interval P0 corresponds to a center-to-center distance of a channel width in a direction (second direction S) in which the common supply channel branch 52 and the common collection channel branch 53 are alternately arranged.

A width W1 of the common supply channel branch 52 is set to be wider than the arrangement interval P2 of the nozzles 11 arranged in the second direction S (here, set to be twice or more). Similarly, a width W2 of the common collection channel branch 53 is also set to be wider than the arrangement interval P2 of the nozzles 11 in the second direction S (here, set to be twice or more).

Figure 10:
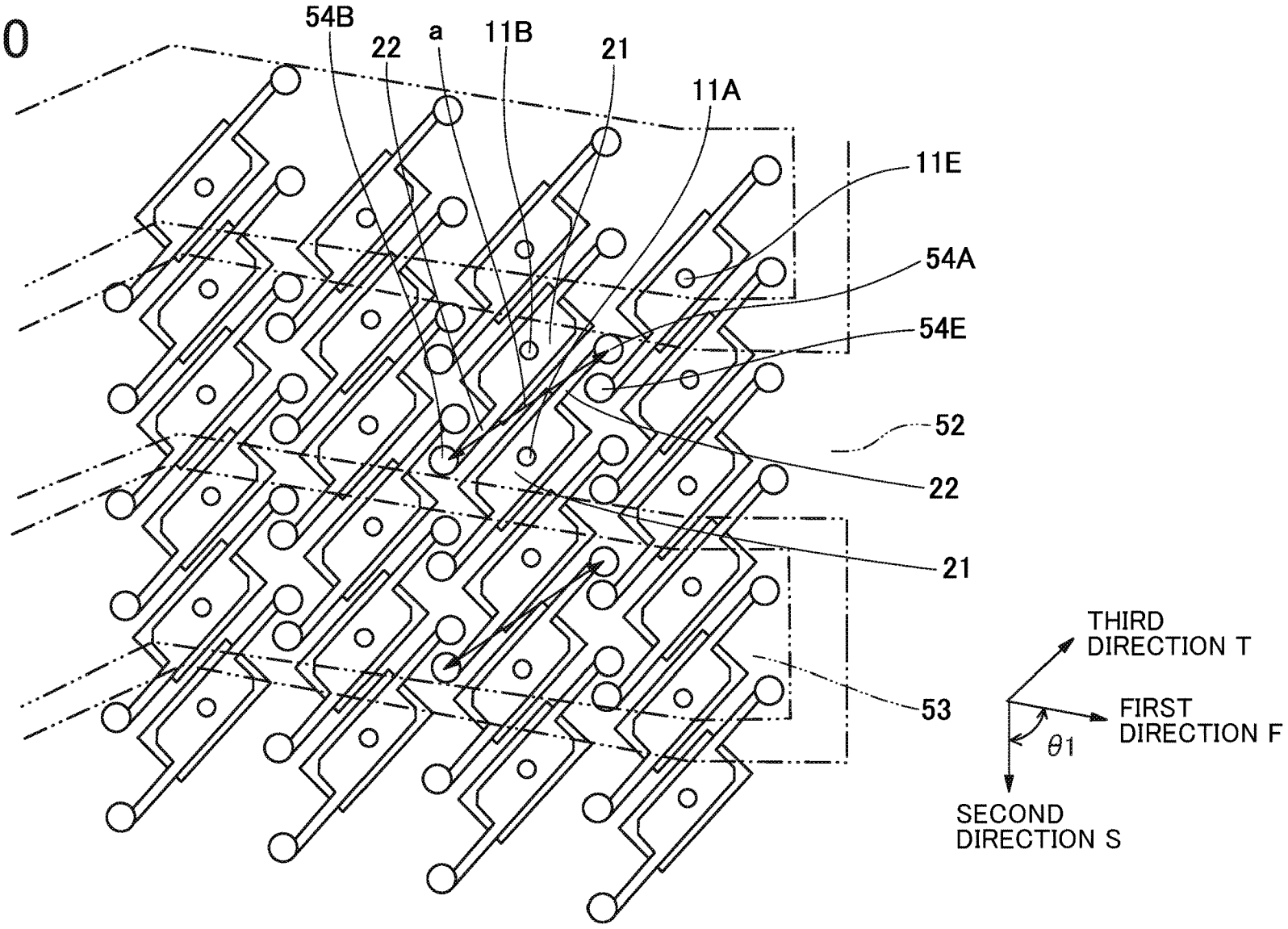
FIG. 10 is an enlarged plan explanatory view of a main part of FIG. 7.

Next, with reference to FIG. 10, a relationship between a distance between the supply ports 54 of the two nearest neighboring nozzles 11 among the nozzles 11 belonging to the same common supply channel branch 52 and a distance from the supply port 54 to the supply side damper 62 will be described.

Here, among combinations of two adjacent nozzles 11, a combination of the nearest neighboring nozzles 11 is referred to as a combination of a first nozzle 11A and a second nozzle 11B. In FIG. 8, the nozzles 11 arranged in the second direction S constitutes a combination of the nearest neighboring nozzles 11 in the same row.

When a supply port 54 communicating with the first nozzle 11A is referred to as a first supply port 54A and a supply port 54 communicating with the second nozzle 11B is referred to as a second supply port 54B, the first supply port 54A communicating with the first nozzle 11A and the second supply port 54B communicating with the second nozzle 11B are arranged in the same common supply channel branch 52.

At this time, a distance a between the first supply port 54A and the second supply port 54B is longer than a distance b (refer to FIG. 6) from the supply port 54 (the first supply port 54A and the second supply port 54B) to the supply side damper 62 (a>b).

In this case, the first supply port 54A and the second supply port 54B are not the nearest neighboring supply ports 54, but the first nozzle 11A and the second nozzle 11B are the nearest neighboring nozzles belonging to the same row.

Meanwhile, a nearest neighboring supply port 54 to the first supply port 54A is the supply port 54E communicating with the nozzle 11E as described above, but the nozzle 11E is arranged in a different row from the first nozzle 11A and the second nozzle 11B.

With such a configuration, when a liquid in the pressure chamber 21 is pressurized and discharged from the nozzle 11, a pressure wave is propagated from the individual supply channel 22 to the common supply channel branch 52 through the first supply port 54A.

At this time, the pressure wave coming out from the first supply port 54A spreads on a spherical surface. Before the pressure wave is propagated to reach the second supply port 54B, the pressure wave reaches the supply side damper 62 and is absorbed because the distance b to the supply side damper 62 is short, and the pressure wave reaching the second supply port 54B decreases.

As a result, pressure interference (mutual interference) with respect to other nozzles 11 through the common supply channel branch 52 can be suppressed, and crosstalk can be reduced.

Meanwhile, a nearest neighboring supply port 54 to the first supply port 54A is the supply port 54E of the nozzle 11E, and a pressure wave due to discharge of a liquid of the first nozzle 11A is propagated to the pressure chamber 21 of the nozzle 11E through the supply port 54E. However, the nozzle 11E is in a different row from the first nozzle 11A and is not driven simultaneously with the nozzle 11A. Therefore, an influence due to crosstalk is reduced.

By adopting the channel arrangement configuration illustrated in FIG. 7 (FIGS. 8 to 11), it is possible to achieve high nozzle density and reduced crosstalk.

That is, in general, by making arrangement such that a distance between any two of the supply ports 54 is larger than a distance between a supply port 54 and the supply side damper 62, it is possible to suppress crosstalk between adjacent nozzles.

However, increasing the distance between the supply ports 54 reduces the arrangement density of the nozzles 11, resulting in increase in head size.

Therefore, by adopting the channel arrangement configuration described above, the mounting density of the individual liquid chambers 21 (arrangement of the nozzles 11) is increased, and the head is downsized.

The distance b from the supply port 54 to the supply side damper 62 is preferably as short as possible. However, it is necessary to set the distance b to an optimum size in consideration of the cross-sectional area of the common supply channel branch 52. In this case, in order to distribute a liquid to the supply ports 54 coupled to the same common supply channel branch 52, the common supply channel branch 52 needs to secure a liquid flow rate corresponding to the number of the nozzles 11 to be coupled.

The distance b from the supply port 54 to the supply side damper 62 corresponds to the channel height of the common supply channel branch 52. Shortening the distance b between the supply port 54 and the supply side damper 62 reduces the channel height of the common supply channel branch 52, reduces the cross-sectional area of the common supply channel branch 52, and increase the fluid resistance of the common supply channel branch 52.

In a case where the fluid resistance of the common supply channel branch 52 is large, fluctuation of a pressure loss in the common supply channel branch 52 increases when the flow rate of each of the nozzles 11 fluctuates due to discharge (the pressure loss depends on a product of resistance and a flow rate). When the pressure loss fluctuates largely, the pressure at each of the nozzles 11 fluctuates according to the flow rate. Therefore, variation in discharge characteristics occurs.

Therefore, in the present embodiment, by adopting the above channel arrangement configuration, the width W1 of one common supply channel branch 52 is set to be equal to or more than twice the arrangement interval P2 of the nozzles 11 in the second direction S, the cross-sectional area is increased, and the fluid resistance is reduced.

In this way, reduction in fluid resistance and reduction in crosstalk can be achieved at the same time.

By increasing the width W1 of the common supply channel branch 52, the width of the supply side damper 62 is widened, and compliance of the supply side damper 62 can be increased. Therefore, by making the channel height of the common supply channel branch 52 sufficiently small and widening the width within a range in which the fluid resistance of the common supply channel branch 52 is permitted, variation in discharge can be reduced while crosstalk is reduced.

Figure 11:
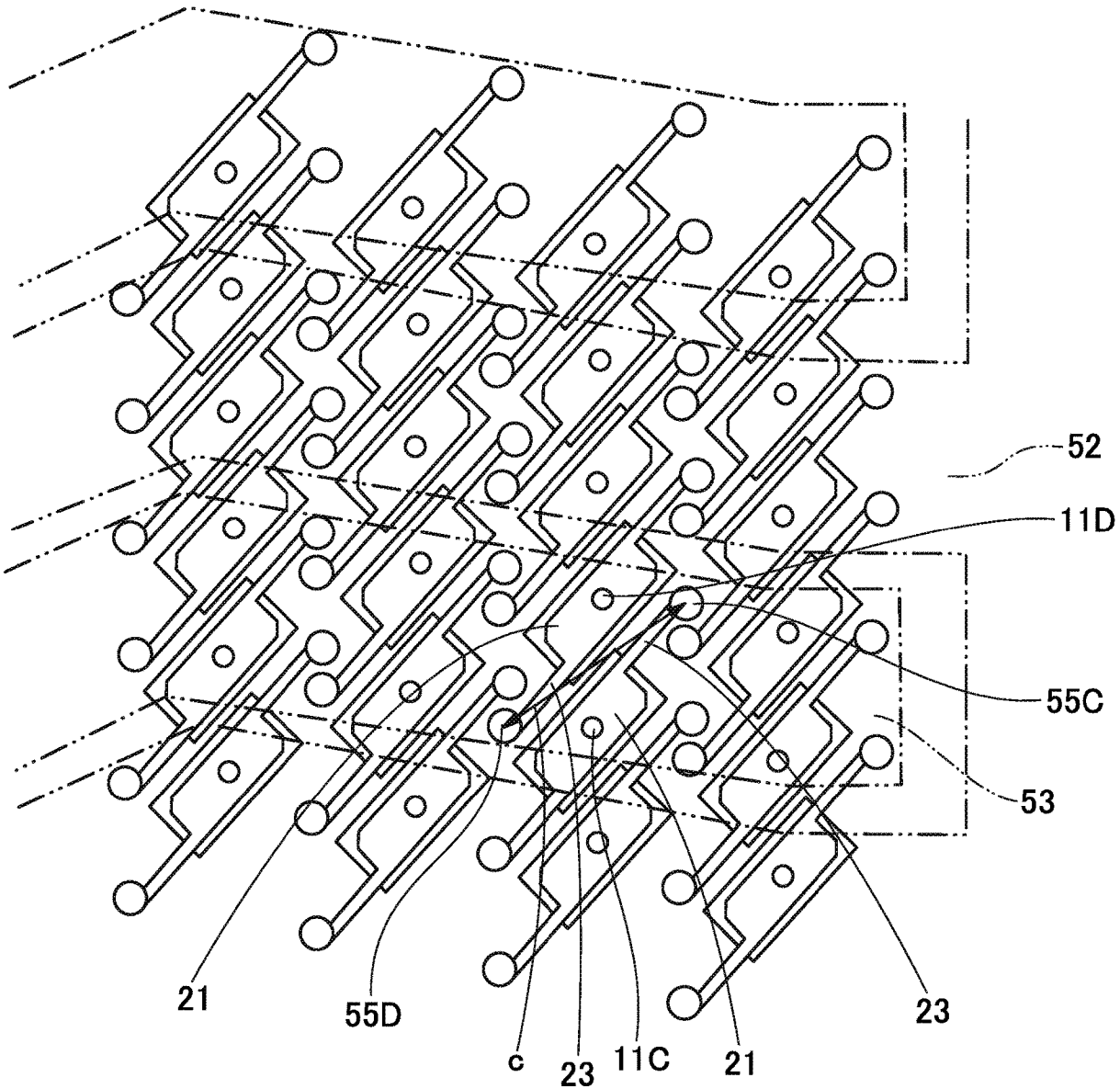
FIG. 11 is an enlarged plan explanatory view of a main part of FIG. 7.

Next, with reference to FIG. 11, in the channel arrangement configuration of the present embodiment, the individual collection channel 23 is arranged on the opposite side to the individual supply channel 22 of the pressure chamber 21, and coupled to the common collection channel branch 53 through the collection port 55. The plurality of common collection channel branches 53 communicate with the common collection channel mainstream 57.

As a result, the liquid discharge head 1 of the present embodiment constitutes an individual liquid chamber (pressure chamber) circulation type head, and can use a liquid with a high drying property or a liquid with a high sedimentation property.

Here, as described above, the common supply channel branch 52 and the common collection channel branch 53 are alternately arranged. On a wall surface of the common collection channel branch 53, the collection side damper 63 is arranged opposing to the collection port 55.

The pressure wave generated in the pressure chamber 21 at the time of discharge interferes with other nozzles 11 through not only the supply side but also the common collection channel branch 53. Similarly to the common supply channel branch 52, variation in discharge characteristics occurs through the common collection channel branch 53 due to crosstalk.

Therefore, by disposing the collection side damper 63 on a wall surface of the common collection channel branch 53, it is possible to reduce crosstalk through the common collection channel branch 53.

Here, similarly to the supply side, among combinations of two adjacent nozzles 11, a combination of the nearest neighboring nozzles 11 is referred to as a combination of a third nozzle 11C and a fourth nozzle 11D. In FIG. 11, the nozzles 11 arranged in the second direction S are a combination of the nearest neighboring nozzles 11 in the same row.

When a collection port 55 communicating with the third nozzle 11C is referred to as a first collection port 55C and a collection port 55 communicating with the fourth nozzle 11D is referred to as a second collection port 55D, the first collection port 55C communicating with the third nozzle 11C and the second collection port 55D communicating with the fourth nozzle 11D are arranged in the same common collection channel branch 53.

A distance c between the first collection port 55C and the second collection port 55D is longer than a distance d (=b) from the collection port 55 (the first collection port 55C and the second collection port 55D) to the collection side damper 63, (c>d).

Here, the first collection port 55C and the second collection port 55D are not the nearest neighboring collection ports 55, but the third nozzle 11C and the fourth nozzle 11D are the nearest neighboring nozzles belonging to the same row.

With such a configuration, in a case where a liquid in the pressure chamber 21 is pressurized and discharged from the nozzle 11, when a pressure wave is propagated from the individual collection channel 23 to the common collection channel branch 53 through the first collection port 55C, before the pressure wave coming out from the first collection port 55C is propagated to reach the second collection port 55D, the pressure wave reaches the collection side damper 63 and is absorbed and attenuated.

As a result, pressure interference (mutual interference) with respect to other nozzles 11 through the common collection channel branch 53 can be suppressed, and crosstalk can be reduced.

In the present embodiment, the common supply channel branch 52 and the common collection channel branch 53 are alternately arranged in the common channel substrate 50.

As a result, with a single damper member 60, the supply side damper 62 of the common supply channel branch 52 and the collection side damper 63 of the common collection channel branch 53 can be formed, and the head can be downsized.

As described above, the arrangement interval P0 between the common supply channel branch 52 and the common collection channel branch 53 is set to be equal to or more than twice the arrangement interval P2 of the nozzles 11 in the second direction S. Similarly to the width W1 of the common supply channel branch 52, the width W2 of the common collection channel branch 53 is also set to be equal to or more than twice the arrangement interval P2 of the nozzles 11 in the second direction S.

This makes it possible to increase compliance of the collection side damper 63 and to sufficiently shorten the distance between the collection side damper 63 and the collection port 55 while reducing the fluid resistance also in the common collection channel branch 53.

Therefore, it is possible to reduce crosstalk due to propagation of the pressure wave, to cope with various liquids by the circulation type head, and to improve reliability.

As described above, by adopting the channel arrangement configuration described with reference to FIGS. 7 to 11, it is possible to reduce the fluid resistance of each of the common supply channel branch and the common collection channel branch, to increase compliance of a damper disposed in each of the common supply channel branch and the common collection channel branch, to downsize the head, to reduce crosstalk, and to improve characteristic stability by reduction in fluid resistance.

Figure 12:
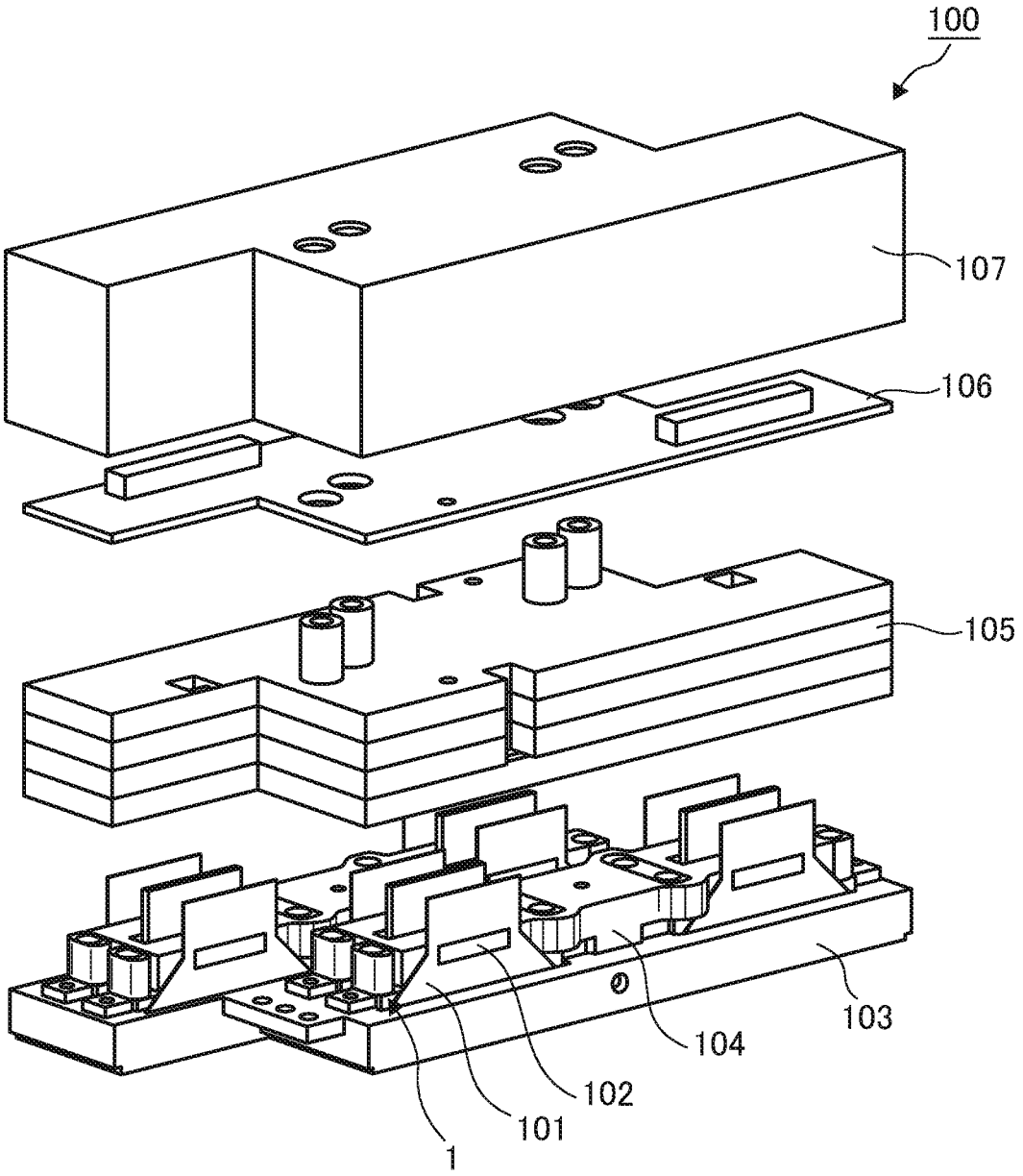
FIG. 12 is an exploded perspective explanatory view of an example of a head module according to an embodiment of the present disclosure.
Figure 13:
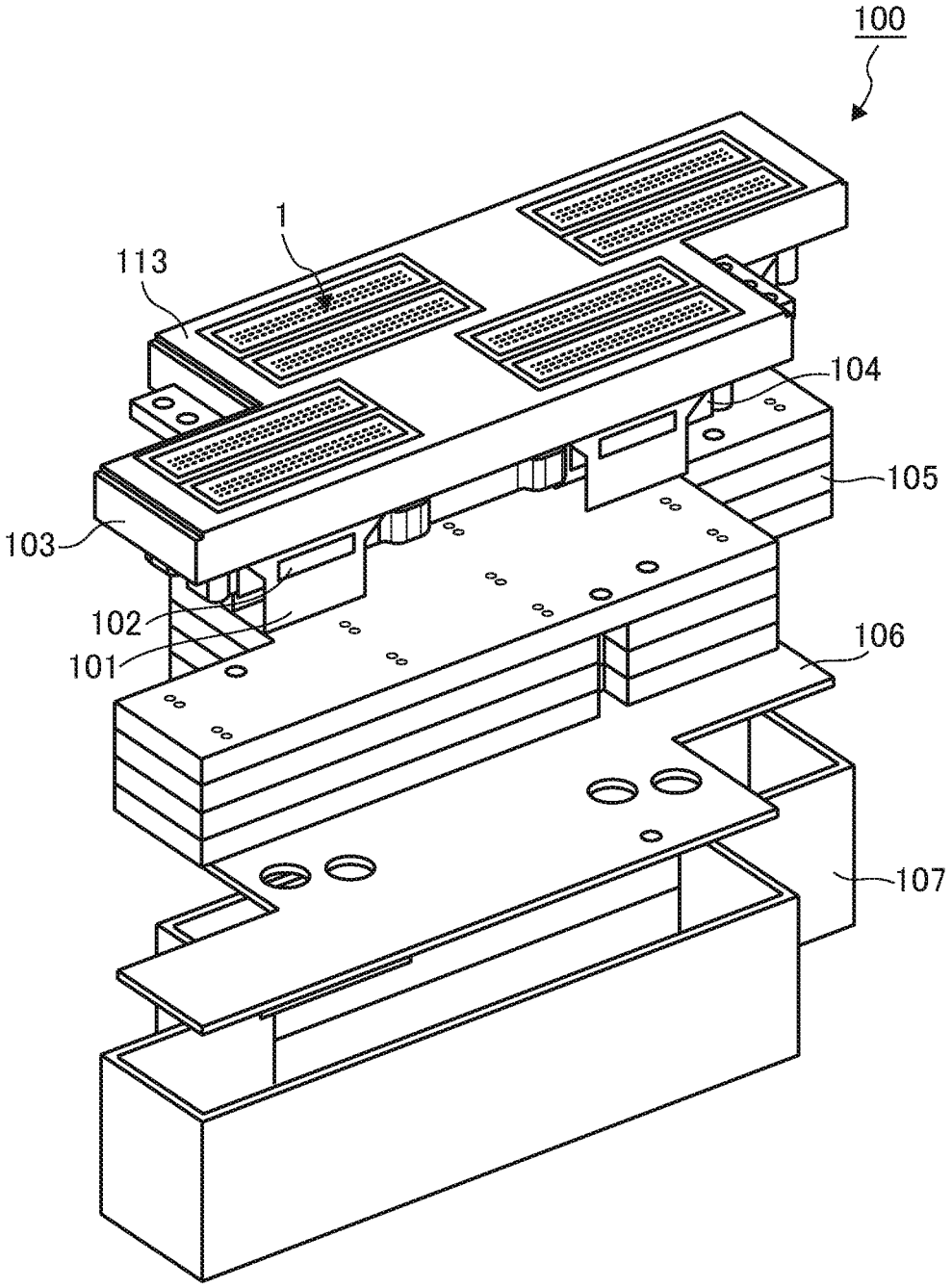
FIG. 13 is an exploded perspective explanatory view of the head module as viewed from the side of a nozzle surface.

Next, an example of a head module according to an embodiment of the present disclosure will be described with reference to FIGS. 12 and 13. FIG. 12 is an exploded perspective explanatory view of the head module. FIG. 13 is an exploded perspective explanatory view of the head module as viewed from the side of a nozzle surface.

A head module 100 includes a plurality of heads 1 which are liquid discharge heads for discharging a liquid, a base member 103 holding the plurality of heads 1, and a cover member 113 which is a nozzle cover of the plurality of heads 1.

The head module 100 further includes a heat radiation member 104, a manifold 105 forming a channel for supplying a liquid to a plurality of heads, a printed circuit board (PCB) 106 coupled to a flexible wiring member 101, and a module case 107.

Figure 14:
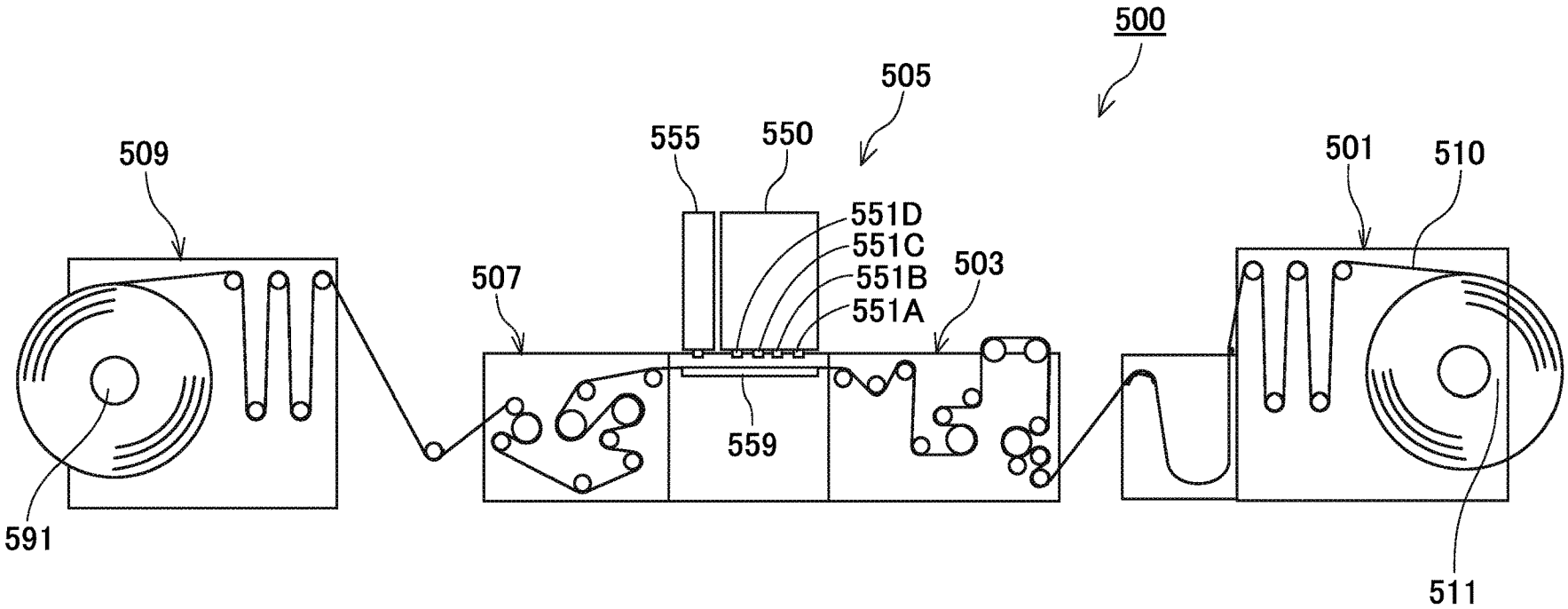
FIG. 14 is a schematic explanatory view of an example of a liquid discharge apparatus according to an embodiment of the present disclosure.
Figure 15:
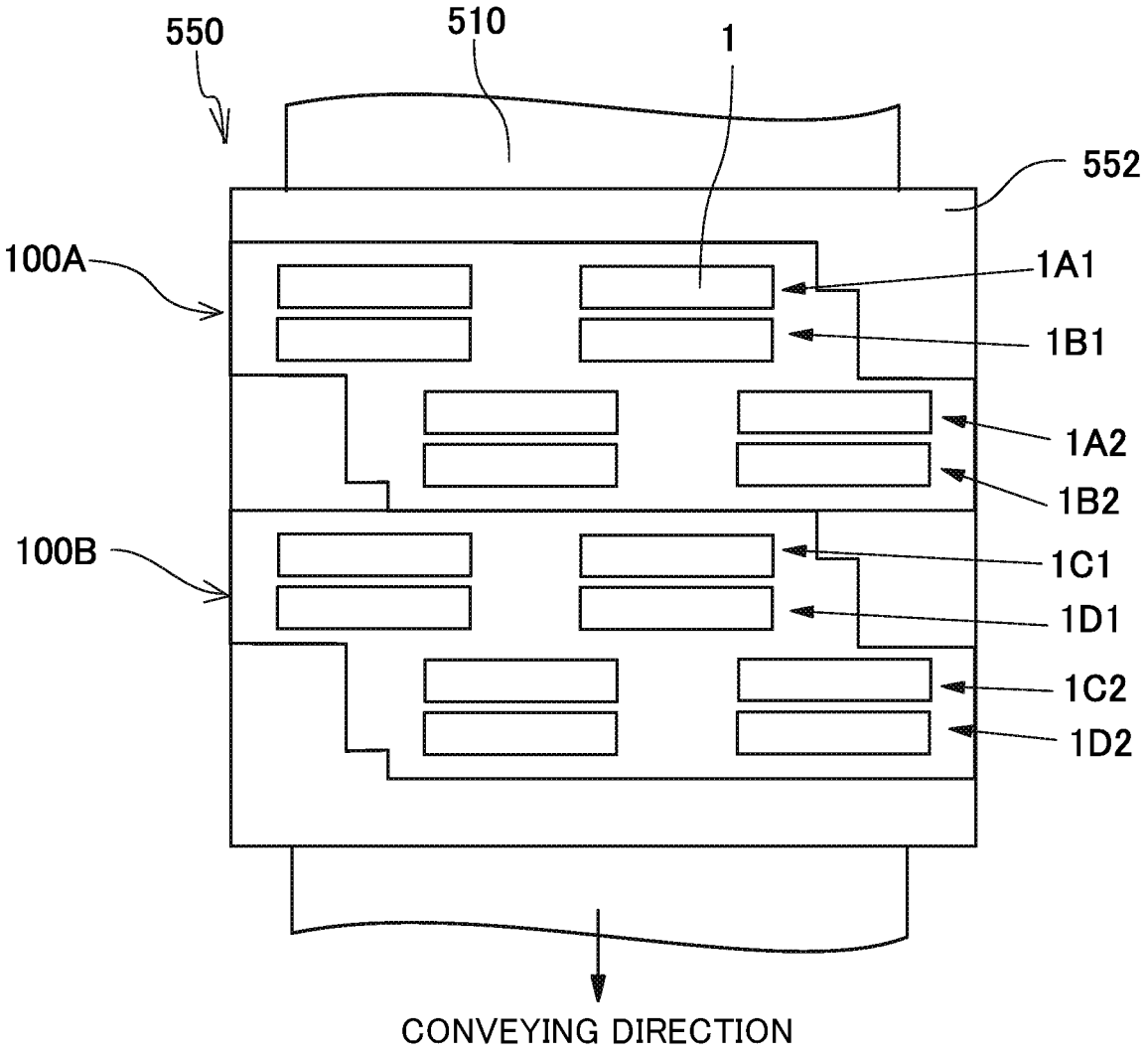
FIG. 15 is a plan explanatory view of an example of a head unit of the apparatus.

Next, an example of a liquid discharge apparatus according to an embodiment of the present disclosure will be described with reference to FIGS. 14 and 15. FIG. 14 is a schematic explanatory view of the apparatus. FIG. 15 is a plan explanatory view of an example of a head unit of the apparatus.

A printer 500 which is the liquid discharge apparatus includes a carry-in unit 501 for carrying a continuous body 510 in, a guiding and conveying unit 503 for guiding and conveying the continuous body 510 carried in from the carry-in unit 501 to a printer 505, the printer 505 for discharging a liquid onto the continuous body 510 and performing printing to form an image, a dryer 507 for drying the continuous body 510, a carry-out unit 509 for carrying the continuous body 510 out, and the like.

The continuous body 510 is fed out from an original winding roller 511 of the carry-in unit 501, guided and conveyed by each roller of the carry-in unit 501, the guiding and conveying unit 503, the dryer 507, and the carry-out unit 509, and wound by a winding roller 591 of the carry-out unit 509.

In the printer 505, the continuous body 510 is conveyed on a conveying guide member 559 opposing to a head unit 550, and an image is printed by a liquid discharged from the head unit 550.

Here, the head unit 550 includes two head modules 100A and 100B according to an embodiment of the present disclosure in a common base member 552.

If an arrangement direction of the heads 1 in a direction orthogonal to a conveying direction of the head module 100 is referred to as a head arrangement direction, liquids of the same color are discharged by head rows 1A1 and 1A2 of the head module 100A. Similarly, head rows 1B1 and 1B2 of the head module 100A are set as a combination, head rows 1C1 and 1C2 of the head module 100B are set as a combination, head rows 1D1 and 1D2 are set as a combination, and a liquid of a required color is discharged from each of the combinations.

Figure 16:
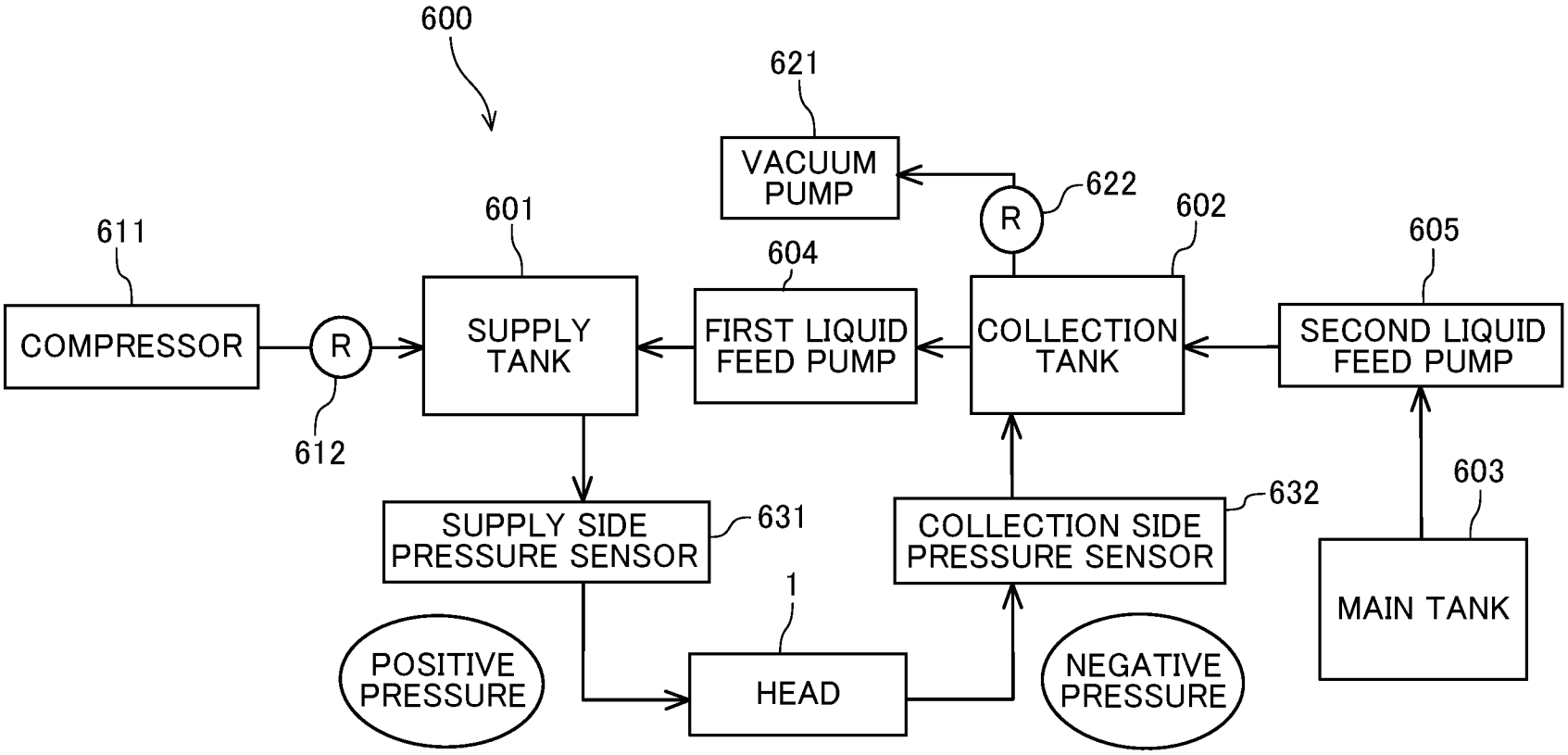
FIG. 16 is an explanatory block diagram of an example of a liquid circulation device.

Next, an example of a liquid circulation device will be described with reference to FIG. 16. FIG. 16 is an explanatory block diagram of the liquid circulation device. Note that only one head is illustrated here. However, in a case where a plurality of heads is arranged, a supply side liquid path and a collection side liquid path are coupled to a supply side and a collection side of the plurality of heads through a manifold or the like, respectively.

A liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply side pressure sensor 631, a collection side pressure sensor 632, and the like.

Here, the compressor 611 and the vacuum pump 621 constitute a means for generating a differential pressure between a pressure in the supply tank 601 and a pressure in the collection tank 602.

The supply side pressure sensor 631 is disposed between the supply tank 601 and the head 1 and coupled to a supply side liquid path connected to a supply port 81 of the head 1. The collection side pressure sensor 632 is disposed between the head 1 and the collection tank 602 and coupled to a collection side liquid path connected to a collection port 82 of the head 1.

One side of the collection tank 602 is coupled to the supply tank 601 through the first liquid feed pump 604, and the other side of the collection tank 602 is coupled to the main tank 603 through the second liquid feed pump 605.

As a result, a liquid flows from the supply tank 601 through the supply port 71 into the head 1, collected from the collection port 72 to the collection tank 602, and fed from the collection tank 602 to the supply tank 601 by the first liquid feed pump 604. This constitutes a circulation path in which a liquid circulates.

Here, the compressor 611 is connected to the supply tank 601, and control is performed such that a predetermined positive pressure is detected by the supply side pressure sensor 631. Meanwhile, the vacuum pump 621 is connected to the collection tank 602, and control is performed such that a predetermined negative pressure is detected by the collection side pressure sensor 632.

As a result, the negative pressure of a meniscus can be kept constant while a liquid is circulated through the inside of the head 1.

When a liquid is discharged from the nozzle 11 of the head 1, the liquid amount in the supply tank 601 and the collection tank 602 decreases. Therefore, the collection tank 602 is appropriately replenished with a liquid from the main tank 603 using the second liquid feed pump 605.

Note that the timing of replenishing the collection tank 602 with a liquid from the main tank 603 can be controlled by a detection result of a liquid level sensor or the like disposed in the collection tank 602, for example, replenishment with a liquid is performed when the liquid level height of a liquid in the collection tank 602 falls below a predetermined height.

Figure 17:
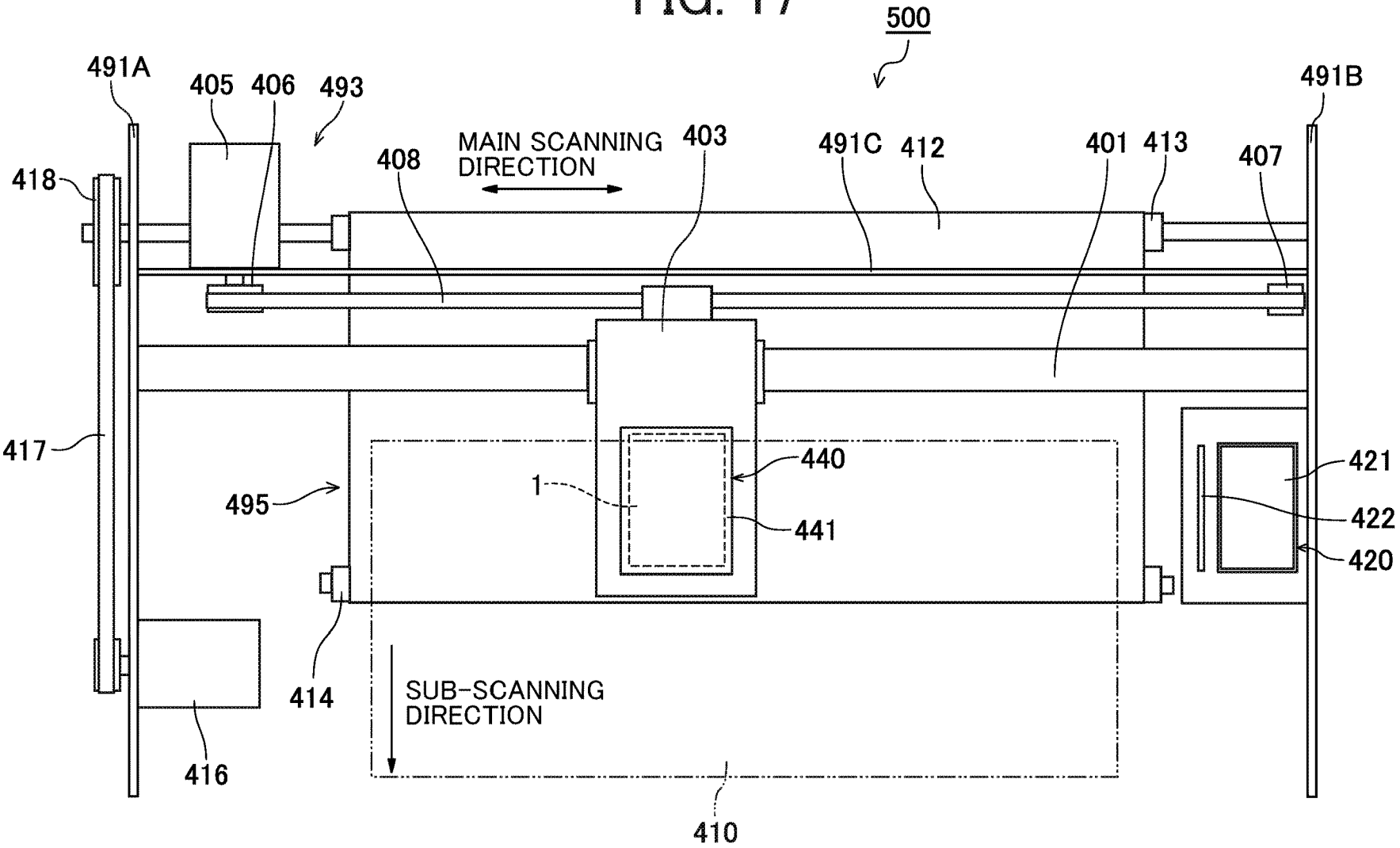
FIG. 17 is a plan explanatory view of a main part of another example of a printer as a liquid discharge apparatus according to an embodiment of the present disclosure.
Figure 18:
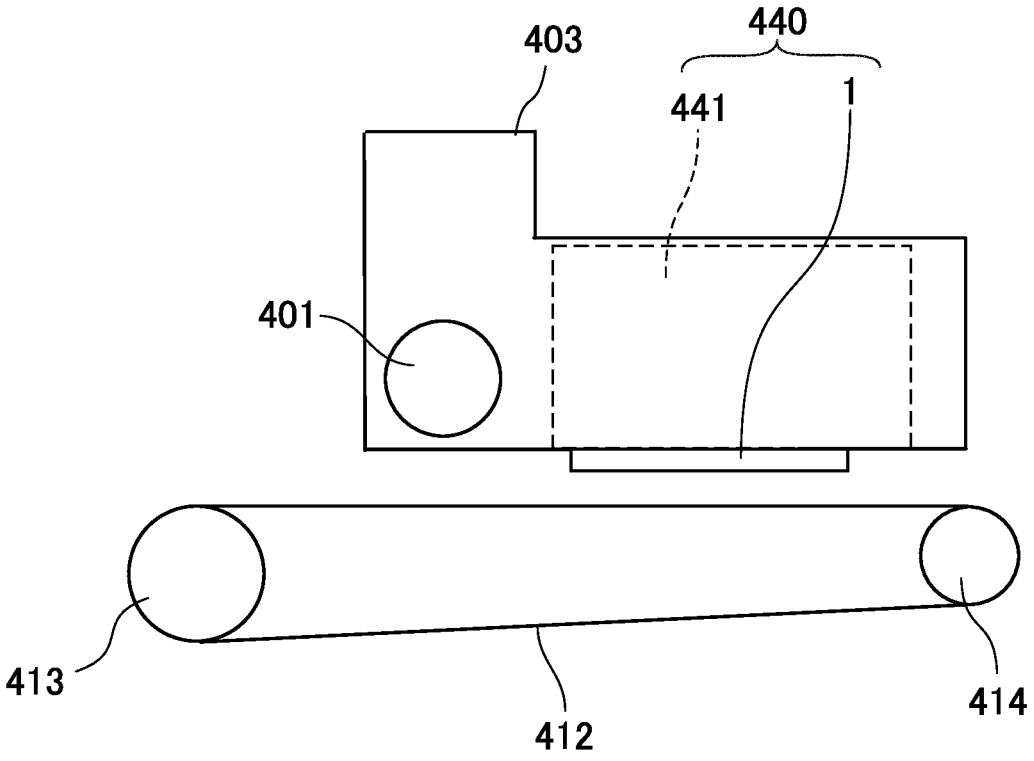
FIG. 18 is a side explanatory view of a main part of the printer.

Next, another example of a printer as a liquid discharge apparatus according to an embodiment of the present disclosure will be described with reference to FIGS. 17 and 18. FIG. 17 is a plan explanatory view of a main part of the printer. FIG. 18 is a side explanatory view of a main part of the printer.

The printer 500 is a serial type apparatus, and a carriage 403 reciprocates in a main scanning direction by a main scanning movement mechanism 493. The main scanning movement mechanism 493 includes a guide member 401, a main scanning motor 405, a timing belt 408, and the like. The guide member 401 is bridged between left and right side plates 491A and 491B so as to movably hold the carriage 403. The main scanning motor 405 reciprocates the carriage 403 in the main scanning direction through the timing belt 408 bridged between a driving pulley 406 and a driven pulley 407.

The carriage 403 has a liquid discharge device 440 in which a head 1 which is a droplet discharge head according to an embodiment of the present disclosure and a head tank 441 are integrated mounted thereon. The head 1 of the liquid discharge device 440 discharges liquids of colors of, for example, yellow (Y), cyan (C), magenta (M), and black (K). The liquid discharge head 1 arranges nozzle rows including a plurality of nozzles in a sub-scanning direction orthogonal to the main scanning direction with a discharge direction downward.

The liquid discharge head 1 is coupled to the above-described liquid circulation device 600, and a liquid of a required color is circulated and supplied.

The printer 500 includes a conveying mechanism 495 for conveying a sheet 410. The conveying mechanism 495 includes a conveying belt 412 as a conveyer and a sub-scanning motor 416 for driving the conveying belt 412.

The conveying belt 412 attracts the sheet 410 and conveys the sheet 410 at a position opposing to the head 1. The conveying belt 412 is an endless belt, and is bridged between a conveying roller 413 and a tension roller 414. Attraction can be performed by electrostatic attraction, air suction, or the like.

The conveying belt 412 is rotated in the sub-scanning direction by rotation of the conveying roller 413 through the timing belt 417 and the timing pulley 418 by the sub-scanning motor 416.

Furthermore, on one side of the carriage 403 in the main scanning direction, a maintenance and recovery mechanism 420 for maintaining and recovering the liquid discharge head 1 is disposed on a side of the conveying belt 412.

The maintenance and recovery mechanism 420 includes, for example, a cap member 421 for capping a nozzle surface of the head 1, a wiper member 422 for wiping the nozzle surface, and the like.

The main scanning movement mechanism 493, the maintenance and recovery mechanism 420, and the conveying mechanism 495 are attached to a housing including side plates 491A and 491B, and a back plate 491C.

In the printer 500 having such a configuration, the sheet 410 is fed onto the conveying belt 412, attracted, and conveyed in the sub-scanning direction by rotation of the conveying belt 412.

Therefore, by driving the head 1 in accordance with an image signal while the carriage 403 moves in the main scanning direction, a liquid is discharged onto the sheet 410 being stopped to form an image.

Figure 19:
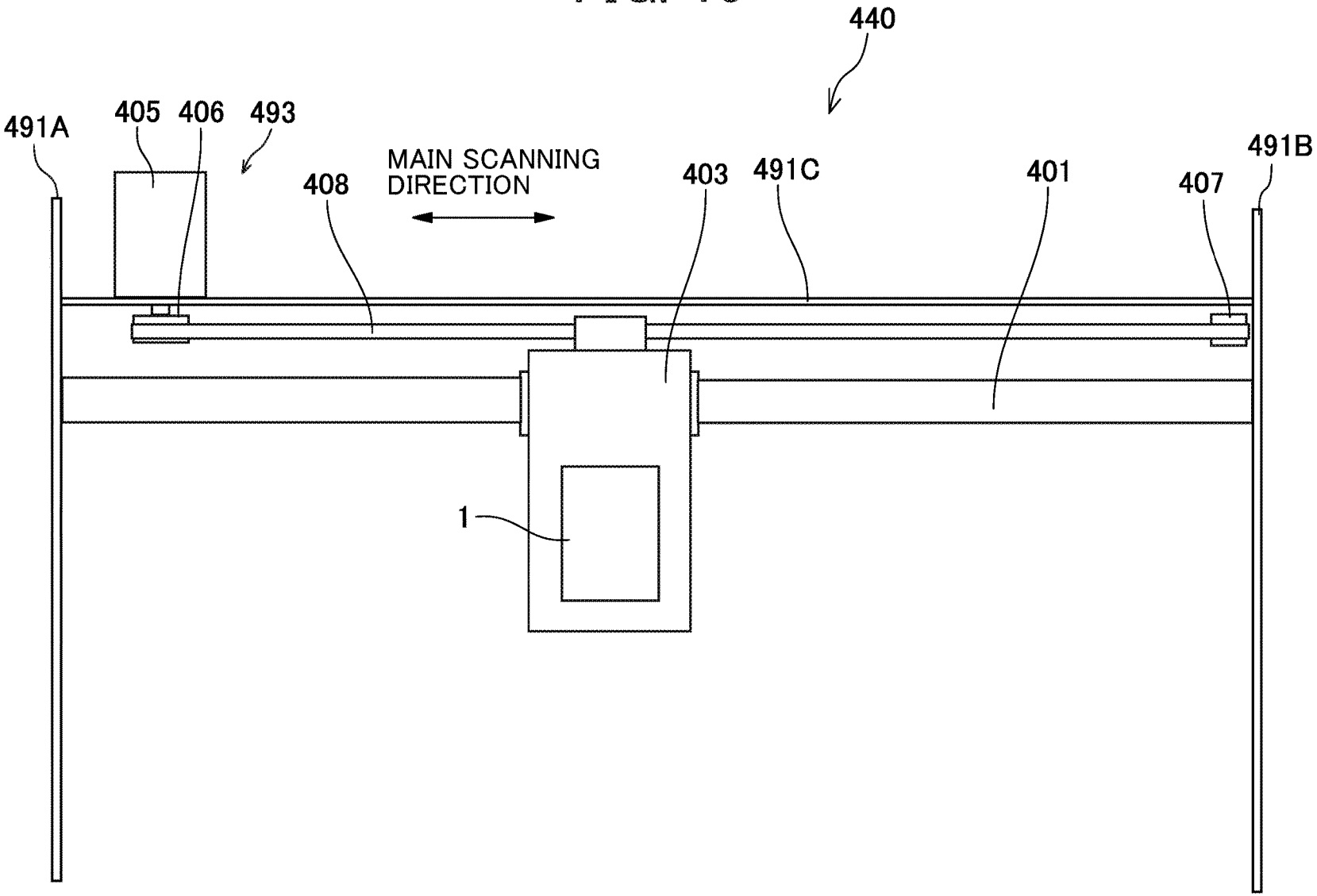
FIG. 19 is a plan explanatory view of a main part of an example of a liquid discharge device according to an embodiment of the present disclosure.

Next, another example of a liquid discharge device according to an embodiment of the present disclosure will be described with reference to FIG. 19. FIG. 19 is a plan explanatory view of a main part of the device.

A liquid discharge device 440 includes a housing portion including the side plates 491A and 491B and the back plate 491C, the main scanning movement mechanism 493, the carriage 403, and the head 1 among the members included in the liquid discharge apparatus.

Note that a liquid discharge device in which the above-described maintenance and recovery mechanism 420 is further attached to, for example, the side plate 491B of the liquid discharge device 440 can be formed.

Figure 20:
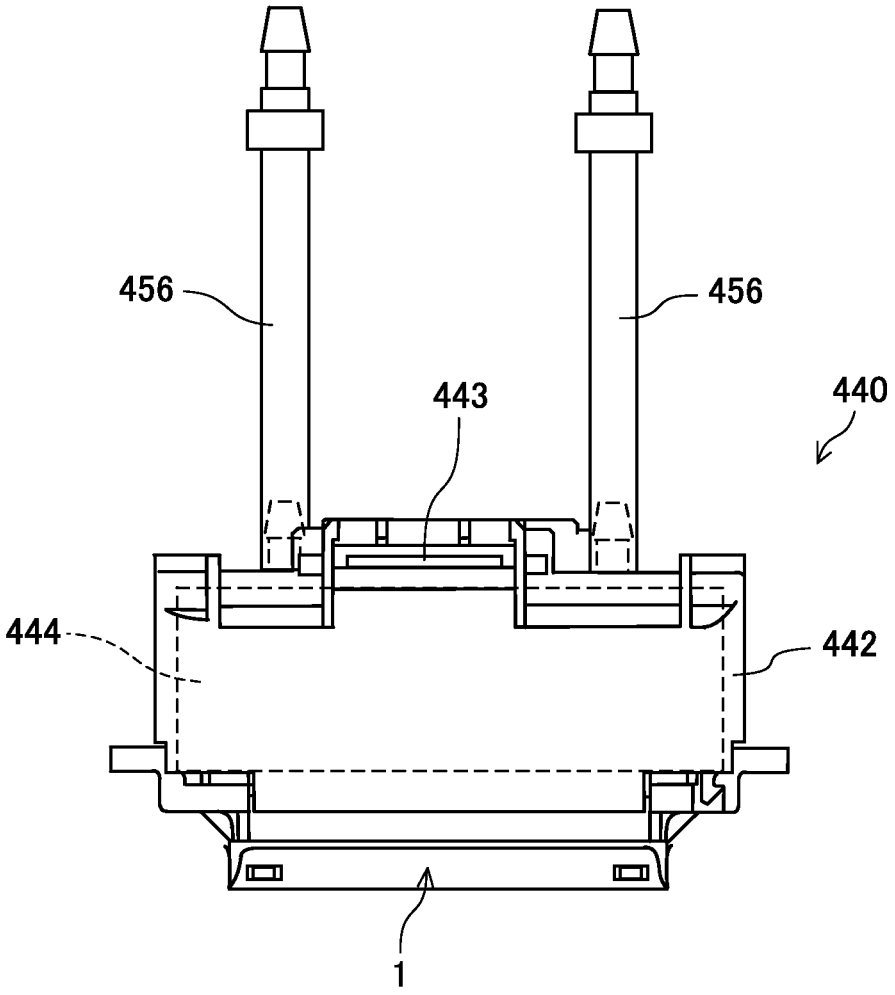
FIG. 20 is a front explanatory view of another example of a liquid discharge device according to an embodiment of the present disclosure.

Next, still another example of a liquid discharge device according to an embodiment of the present disclosure will be described with reference to FIG. 20. FIG. 20 is a front explanatory view of the device.

A liquid discharge device 440 includes a head 1 to which a channel component 444 is attached and a tube 456 coupled to the channel component 444.

Note that the channel component 444 is disposed in a cover 442. Instead of the channel component 444, a head tank 441 can be included. A connector 443 for making electrical connection with the liquid discharge head 1 is disposed on an upper part of the channel component 444.

In the present application, a liquid to be discharged is not particularly limited as long as having viscosity and surface tension which makes it possible to discharge the liquid from a head. However, the liquid preferably has viscosity of 30 mPa·s or less at ordinary temperature and ordinary pressure or by heating and cooling. More specific examples of the liquid include a solution, a suspension, and an emulsion containing a solvent such as water or an organic solvent, a colorant such as a dye or a pigment, a functionalizing material such as a polymerizable compound, a resin, or a surfactant, a biocompatible material such as DNA, an amino acid, a protein, or calcium, or an edible material such as a natural dye. These liquids can be used, for example, for an inkjet ink, a surface treatment-liquid, a liquid for forming a constituent element of an electronic element or a light-emitting element or an electronic circuit resist pattern, or a three-dimensional modeling material liquid.

Examples of an energy generating source for discharging a liquid include those using a piezoelectric actuator (laminated piezoelectric element and thin film piezoelectric element), a thermal actuator using an electrothermal transducer such as a heat generating resistor, and an electrostatic actuator including a diaphragm and a counter electrode.

The "liquid discharge device" is a device in which a liquid discharge head is integrated with a functional component and a mechanism, and includes a group of components related to discharge of a liquid. Examples of the "liquid discharge device" include a combination of a liquid discharge head with at least one of configurations of a head tank, a carriage, a supply mechanism, a maintenance and recovery mechanism, a main scanning movement mechanism, and a liquid circulation device.

Here, examples of the integration include a form in which a liquid discharge head, a functional component, and a mechanism are secured to each other by fastening, bonding, engagement, or the like, and a form in which one is held movably with respect to the other. A liquid discharge head, a functional component, and a mechanism may be detachable from each other.

Examples of the liquid discharge device include a device in which a liquid discharge head is integrated with a head tank. Examples of the liquid discharge device further include a device in which a liquid discharge head and a head tank are coupled to each other with a tube or the like to be integrated with each other. Here, a unit including a filter may be added between a head tank of the liquid discharge device and a liquid discharge head.

Examples of the liquid discharge device further include a device in which a liquid discharge head is integrated with a carriage.

Examples of the liquid discharge device further include a device in which a liquid discharge head is movably held by a guide member constituting a part of a main scanning movement mechanism and the liquid discharge head is integrated with the main scanning movement mechanism. Examples of the liquid discharge device further include a device in which a liquid discharge head, a carriage, and a main scanning movement mechanism are integrated with each other.

Examples of the liquid discharge device further include a device in which a cap member which is a part of a maintenance and recovery mechanism is secured to a carriage to which a liquid discharge head is attached to integrate the liquid discharge head, the carriage, and the maintenance and recovery mechanism with each other.

Examples of the liquid discharge device further include a device in which a tube is coupled to a liquid discharge head to which a head tank or a channel component is attached to integrate the liquid discharge head with a supply mechanism. Through this tube, a liquid in a liquid storage source is supplied to the liquid discharge head.

The main scanning movement mechanism also includes a single guide member. The supply mechanism also includes a single tube and a single loading unit.

Note that the "liquid discharge device" has been described in combination with the liquid discharge head here. However, the "liquid discharge device" also includes a device in which a head module including the above-described liquid discharge head and a head unit are integrated with the above-described functional component and mechanism.

The "liquid discharge apparatus" includes an apparatus including a liquid discharge head, a liquid discharge device, a head module, a head unit, and the like for driving the liquid discharge head to discharge a liquid. The "liquid discharge apparatus" includes not only an apparatus capable of discharging a liquid onto a liquid-attachable object but also an apparatus for discharging a liquid toward a gas or a liquid.

The "liquid discharge apparatus" may also include a means related to feeding, conveying, or discharge of a liquid-attachable object, a pretreatment device, a post-treatment device, and the like.

Examples of the "liquid discharge apparatus" include an image forming apparatus for discharging an ink to form an image on a sheet and a stereoscopic modeling apparatus (three-dimensional modeling apparatus) for discharging a modeling liquid onto a powder layer obtained by forming a powder into a layer shape in order to model a stereoscopic modeled object (three-dimensional modeled object).

The "liquid discharge apparatus" is not limited to an apparatus in which a significant image such as a letter or a graphic is visualized by a discharged liquid. Examples of the "liquid discharge apparatus" include an apparatus for forming a pattern or the like having no meaning by itself and an apparatus for modeling a three-dimensional image.

The "liquid-attachable object" means an object to which a liquid can be attached at least temporarily, and means an object causing adhesion by attachment, an object causing permeation by attachment, or the like. Specific examples of the "liquid-attachable object" include a recording medium such as a sheet, recording paper, a recording sheet, a film, or a cloth, an electronic component such as an electronic substrate or a piezoelectric element, and a medium such as a powder layer (powdery layer), an organ model, or an inspection cell. Unless particularly limited, the "liquid-attachable object" includes everything to which a liquid is attached.

A material of the "liquid-attachable object" may be any material as long as a liquid can be attached to the object even temporarily, such as paper, yarn, fiber, cloth, leather, metal, plastic, glass, wood, or ceramics.

The "liquid discharge apparatus" includes an apparatus in which a liquid discharge head and a liquid-attachable object move relatively to each other, but is not limited thereto. Specific examples thereof include a serial type apparatus for moving a liquid discharge head and a line type apparatus for not moving a liquid discharge head.

Examples of the "liquid discharge apparatus" further include a treatment liquid application apparatus for discharging a treatment liquid onto a sheet in order to apply the treatment liquid to a surface of the sheet, for example, in order to modify the surface of the sheet, and a spraying granulation apparatus for spraying a composition liquid in which a raw material is dispersed in a solution via a nozzle to granulate fine particles of the raw material.

Incidentally, in the terms of the present application, image formation, recording, letter printing, photograph printing, printing, modeling, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge head comprising:

a plurality of nozzles configured to discharge a liquid;

a plurality of pressure chambers respectively communicating with the plurality of nozzles;

a plurality of individual supply channels respectively communicating with the plurality of pressure chambers;

a plurality of individual collection channels respectively communicating with the plurality of pressure chambers;

a plurality of common supply channel branches communicating with two or more of the individual supply channels; and a plurality of common collection channel branches communicating with two or more of the individual collection channels, wherein the plurality of nozzles is two-dimensionally arranged in a matrix and arranged in at least a first direction and a second direction intersecting with the first direction at an inclination, the common supply channel branches and the common collection channel branches extend in the first direction, the common supply channel branches and the common collection channel branches are alternately arranged in the second direction, and an arrangement interval between the common supply channel branches and the common collection channel branches is greater than or equal to twice an arrangement interval between the nozzles arranged in the second direction.

2. The liquid discharge head according to claim 1, wherein the arrangement interval of the nozzles adjacent in the second direction is shorter than an arrangement interval of the nozzles adjacent in another direction.

3. The liquid discharge head according to claim 1, wherein an individual channel including the pressure chamber, the individual supply channel, and the individual collection channel is two-fold rotationally symmetrical with respect to a center axis of the nozzles in a discharge direction, and reversed and disposed with respect to nozzles adjacent to each other in a third direction along a longitudinal direction of the individual channel.

4. The liquid discharge head according to claim 1, wherein two of the nozzles having nearest neighboring supply ports communicating with the individual supply channels in the same common supply channel branch communicate with different common collection channel branches through the individual collection channels.

5. A head module comprising a plurality of the liquid discharge heads according to claim 1 arranged therein.

6. A head unit comprising the head modules according to claim 5 arranged therein.

7. A liquid discharge device comprising the liquid discharge head according to claim 1, the head module according to claim 5, or the head unit according to claim 6.

8. The liquid discharge device according to claim 7, wherein the liquid discharge head is integrated with at least one of a head tank and configured store a liquid to be supplied to the liquid discharge head, a carriage having the liquid discharge head mounted thereon, a supply mechanism configured to supply a liquid to the liquid discharge head, a maintenance and recovery mechanism configured to perform maintenance and recovery of the liquid discharge head, and a main scanning movement mechanism configured move the liquid discharge head in a main scanning direction.

9. A liquid discharge apparatus comprising the liquid discharge device according to claim 7.

10. A liquid discharge apparatus comprising the head unit according to claim 6.

11. A liquid discharge apparatus comprising the head module according to claim 5.

12. A liquid discharge apparatus comprising the liquid discharge head according to claim 1.

13. A liquid discharge head comprising:

a plurality of nozzles configured to discharge a liquid;

a plurality of pressure chambers respectively communicating with the plurality of nozzles;

a plurality of individual supply channels respectively communicating with the plurality of pressure chambers;

a plurality of individual collection channels respectively communicating with the plurality of pressure chambers;

a plurality of common supply channel branches communicating with two or more of the individual supply channels; and a plurality of common collection channel branches communicating with two or more of the individual collection channels, wherein the plurality of nozzles is two-dimensionally arranged in a matrix and arranged in at least a first direction and a second direction intersecting with the first direction at an inclination, the common supply channel branches and the common collection channel branches extend in the first direction, and a width of each of the common supply channel branches and the common collection channel branches is wider than an arrangement interval of the nozzles arranged in the second direction.

14. The liquid discharge head according to claim 13, wherein the arrangement interval of the nozzles adjacent in the second direction is shorter than an arrangement interval of the nozzles adjacent in another direction.

15. The liquid discharge head according to claim 13, wherein an individual channel including the pressure chamber, the individual supply channel, and the individual collection channel is two-fold rotationally symmetrical with respect to a center axis of the nozzles in a discharge direction, and reversed and disposed with respect to nozzles adjacent to each other in a third direction along a longitudinal direction of the individual channel.

16. The liquid discharge head according to claim 13, wherein two of the nozzles having nearest neighboring supply ports communicating with the individual supply channels in the same common supply channel branch communicate with different common collection channel branches through the individual collection channels.

17. A head module comprising a plurality of the liquid discharge heads according to claim 13 arranged therein.

18. A head unit comprising the head modules according to claim 17 arranged therein.

19. A liquid discharge device comprising the liquid discharge head according to claim 13, the head module according to claim 5, or the head unit according to claim 6.

20. The liquid discharge device according to claim 19, wherein the liquid discharge head is integrated with at least one of a head tank and configured to store a liquid to be supplied to the liquid discharge head, a carriage having the liquid discharge head mounted thereon, a supply mechanism configured to supply a liquid to the liquid discharge head, a maintenance and recovery mechanism configured to perform maintenance and recovery of the liquid discharge head, and a main scanning movement mechanism configured to move the liquid discharge head in a main scanning direction.

* * * * *